US010356545B2

(12) United States Patent
Chon et al.

(10) Patent No.: US 10,356,545 B2
(45) Date of Patent: Jul. 16, 2019

(54) METHOD AND DEVICE FOR PROCESSING AUDIO SIGNAL BY USING METADATA

(71) Applicant: Gaudio Lab, Inc., Los Angeles, CA (US)

(72) Inventors: Sangbae Chon, Seoul (KR); Hyunoh Oh, Seongnam-si (KR); Taegyu Lee, Seoul (KR)

(73) Assignee: GAUDIO LAB, INC., Los Angeles, CA (US)

( * ) Notice: Subject to any disclaimer, the term of this patent is extended or adjusted under 35 U.S.C. 154(b) by 0 days.

(21) Appl. No.: 15/715,062

(22) Filed: Sep. 25, 2017

(65) Prior Publication Data

US 2018/0091917 A1 Mar. 29, 2018

(30) Foreign Application Priority Data

Sep. 23, 2016 (KR) ..... 10-2016-0122515
Feb. 10, 2017 (KR) ..... 10-2017-0018515

(51) Int. Cl.
*H04S 7/00* (2006.01)
*H04S 3/00* (2006.01)

(52) U.S. Cl.
CPC ..... *H04S 7/303* (2013.01); *H04S 3/008* (2013.01); *H04S 7/305* (2013.01); *H04S 2400/11* (2013.01); *H04S 2420/01* (2013.01)

(58) Field of Classification Search
None
See application file for complete search history.

(56) References Cited

U.S. PATENT DOCUMENTS

2016/0064003 A1* 3/2016 Mehta ..... G10L 19/008 381/23
2016/0227338 A1* 8/2016 Oh ..... H04S 7/303
2016/0266865 A1* 9/2016 Tsingos ..... H04S 7/304
2017/0251321 A1* 8/2017 Samuelsson ..... G10L 21/00
2018/0115850 A1* 4/2018 De Burgh ..... H04S 7/30
2018/0167756 A1* 6/2018 Mateos Sole ..... H04S 3/008
2018/0268829 A1* 9/2018 France ..... G10L 19/008

* cited by examiner

*Primary Examiner* — Paul W Huber
(74) *Attorney, Agent, or Firm* — Ladas & Parry, LLP

(57) ABSTRACT

Disclosed is an audio signal processing device for processing an audio signal. The audio signal processing device includes a receiving unit configured to receive the audio signal; a processor configured to determine whether to render the audio signal by reflecting a location of a sound image simulated by the audio signal on the basis of metadata for the audio signal, and render the audio signal according to a result of the determination; and an output unit configured to output the rendered audio signal.

20 Claims, 21 Drawing Sheets

*FIG. 3A*

```
typedef enum{
   BYPASS = 0,
   PANNING = 1,
   LOW_QUALITY = 2,
   MID_QUALITY = 3,
   HIGH_QUALITY = 4,
} GAO_BINAURAL_EFFECT_STRENGTH;
```

*FIG. 3B*

| | |
|---|---|
| paramBinauralEffectStrength[n][k] | 2 |

n: frame index
k: track index

*FIG. 3C*

| | |
|---|---|
| isForceBinauralEffectStrength[n][k] | 1 |

n: frame index
k: track index

```
isReferenceScreeninfo            1
0: no reference screen info provided
1: reference screen info provided

if (isReferenceScreeninfo) {
        paramReferenceScreenType                5
        paramReferenceScreenSize                5
        paramReferenceScreenAspectRatio         5
        paramReferenceScreenViewingAngle        5
        paramReferenceScreenDistance   5
        paramReferenceSPL                       16
        paramReferenceTransducer                16
        paramReferenceEQ                        16
}

paramReferenceScreenType:
0: reserved
1: Stand-alone HMD - simple screen (cardboard type, ...)
2: Stand-alone HMD - HD screen (GearVR, Deepoon, ...)
3: Stand-alone HMD - UHD screen (TBD)
4: (reserved)
...
9: Tethered HMD - HD screen (Oculus Rift, Vive, ...)
10: Tethered HMD - UHD screen (TBD)
11: (reserved)
...
17: Smartphone - HD screen (<4inch, monoscope)
18: Smartphone - HD screen (>4inch, monoscope)
19: Smartphone - UHD screen (<4inch, monoscope)
20: Smartphone - UHD screen (>4inch, monoscope)
21: Tablet - HD screen
22: Tablet - UHD screen
...
33: PC/TV Monitor (<20inch, monoscope)
34: PC/TV Monitor (<30inch, monoscope)
35: PC/TV Monitor (<50inch, monoscope)
...
```

*FIG. 4*

```
struct GAO_HDR
{
   unsigned int    formatID;
   unsigned char   version;              // shall be set 0x01
   unsigned char   NofHOA;               // number of HOAs. Typically 1
   unsigned char   NofOBJ;               // number of OBJs. less than 64
   unsigned char   NofCHN;               // number of CHNs. MVP does not support this field.
   char            progDesc[128];        // program description
   unsigned int    fs;                   // sampling frequency
   unsigned short  samplePerFrame;       // Sample per Frame

   // Multiple HOA/OBJ/CHN combinations are possible and dynamically allocated using pointer
   std::vector<GAO_HOA_HDR>   pHdrHOA;
   std::vector<GAO_OBJ_HDR>   pHdrOBJ;
   std::vector<GAO_CHN_HDR>   pHdrCHN;

   // added for the extensivility (for example, extension for room property)
   unsigned int    extensionSize = 0;    // Number of extension bits
   std::vector<char> extensionData;
};
```

*FIG. 7*

| | Syntax | No. of bits | Mnemonic | Note |
|---|---|---|---|---|
| raw_data_block() | { | | | |
| | while( (id = **id_syn_ele**) != ID_END ){ | 3 | **uimsbf** | |
| | switch (id) { | | | |
| | case ID_SCE:single_channel_element(); | | | |
| | break; | | | |
| | case ID_CPE:channel_pair_element(); | | | |
| | break; | | | |
| | case ID_CCE:coupling_channel_element(); | | | |
| | break; | | | |
| | case ID_LFE:lfe_channel_element(); | | | |
| | break; | | | |
| | case ID_DSE:data_stream_element(); | | | **0x04** |
| | break; | | | |
| | case ID_PCE:program_config_element(); | | | |
| | break; | | | |
| | case ID_FIL:fill_element(); | | | |
| | break; | | | |
| | }; | | | |
| | } | | | |
| | byte_alignment(); | | | |
| | } | | | |

*FIG. 15A*

| | Syntax | No. of bits | Mnemonic | Note |
|---|---|---|---|---|
| **data_stream_element()** | { | | | |
| | **element_instance_tag;** | 4 | **uimsbf** | |
| | **data_byte_align_flag;** | 1 | **uimsbf** | |
| | cnt = **count;** | 8 | **uimsbf** | |
| | if (cnt == 255) | | | |
| | cnt += **esc_count;** | 8 | **uimsbf** | maximum 512 bytes per frame |
| | if (data_byte_align_flag) | | | |
| | byte_alignment(); | | | |
| | for (i = 0; i < cnt; i++) | | | |
| | **data_stream_byte**[element_instance_tag][i]; | 8 | **uimsbf** | |
| | GaoReadDSE (data_stream_byte); | | | defined in gaoAACIF.c |
| | } | | | |

*FIG. 15B*

| | Syntax | No. of bits | Mnemonic | Note |
|---|---|---|---|---|
| **GaoReadDSE()** | { | | | |
| | GaoReadDSEHdr(); | | | refer functions of |
| | GaoReadDSEMeta(); | | | |
| | } | | | |

*FIG. 15C*

| | Syntax | No. of bits | Mnemonic | Note |
|---|---|---|---|---|
| GaoReadDSEHdr() | { | | | =2+1*CO+2*HOA+2*CH |
| | if ( version=0x01 ) | 8 | uimsbf | |
| | { | | | |
| GaoQuantNPutHdr (2 byte) | if (frameType == 0) { | 1 | uimsbf | 0 with header, 1 without header |
| | NofOBJ | 7 | uimsbf | 7bit |
| | NofHOA | 5 | uimsbf | 5bit |
| | NofCHN | 3 | uimsbf | |
| GaoQuantNPutOBJHdr (NofOBJ Byte) | for ( i=0; i<NofOBJ; i++ ) { | | | Configurations for GAO_OBJ_HDR |
| | obj[i].eleIdx | 6 | uimsbf | |
| | obj[i].isDynmc | 1 | uimsbf | |
| | obj[i].isIntrctv | 1 | uimsbf | |
| | } | | | |
| GaoQuantNPutHOAHdr (NofHOA x 2 Byte) | for ( i=0; i<NofHOA; i++ ) { | | | Configurations for GAO_HOA_HDR |
| | hoa[i].order | 3 | uimsbf | |
| | reserved | 5 | uimsbf | reserved for byte alignment |
| | hoa[i].eleIdx | 6 | uimsbf | |
| | hoa[i].isDynmc | 1 | uimsbf | |
| | hoa[i].isIntrctv | 1 | uimsbf | |
| | } | | | |
| GaoQuantNPutHOAHdr (NofHOA x 2 Byte) | for ( i=0; i<NofCHN; i++ ) { | | | Configurations for GAO_CHN_HDR |
| | chn[i].layoutIdx | 6 | uimsbf | |
| | reserved | 2 | uimsbf | |
| | chn[i].eleIdx | 6 | uimsbf | |
| | chn[i].isDynmc | 1 | uimsbf | |
| | chn[i].isIntrctv | 1 | uimsbf | |
| | } | | | |
| GaoAttachHdrExtension (1+byteHdrExtension Byte) | byteHdrExtension | 8 | uimsbf | reserved for byte alignment |
| | dataHdrExtension | byteHdrExtension x 8 | uimsbf | reserved for Room Property Header |
| | } | | | |
| No header when frameType=1 | else { | | | |
| | reserved | 7 | uimsbf | |
| | } /* end of frameType */ | | | |
| | } /* end of version */ | | | |
| | } | | | |

*FIG. 16A*

| | Syntax | No. of bits | Mnemonic | Note |
|---|---|---|---|---|
| **GaoReadDSEMeta()** | { | | | =2+4*OBJ+5*HOA+5*CHN < 258 |
| | if ( version=0x01 ) | | | |
| | { | | | |
| | for ( i=0; i<NofOBJ; i++ ) { | | | Metadata for GAO_OBJ_META |
| **not applied at the encoder** | if ( **isSame** == 0xFF ) | 8 | uimsbf | 0xFF represents same as previous |
| | { | | | |
| | continue; | | | |
| | } | | | |
| | obj[i].azimuth = isSame << 2 + **azm** | 1 | uimsbf | 0:1:360 |
| | **obj[i].elevation** | 8 | uimsbf | -90:1:90 |
| | **obj[i].distance** | 7 | uimsbf | 0:(1/16):((2^7-1)/16) : to be discussed |
| | **obj[i].gain** | 8 | uimsbf | 0:(1/16):((2^8-1)/16) : to be discussed |
| | } | | | |
| | for ( i=0; i<NofHOA; i++ ) { | | | Configurations for GAO_HOA_HDR |
| | if ( **isSame** == 0xFF ) | 8 | uimsbf | 0xFF represents same as previous |
| | { | | | |
| | continue; | | | |
| | } | | | |
| | hoa[i].yaw = isSame << 2 + **yaw** | 1 | uimsbf | 0~360 |
| | **hoa[i].pitch** | 9 | uimsbf | 0~360 |
| | **hoa[i].roll** | 9 | uimsbf | 0~360 |
| | **hoa[i].gain** | 8 | uimsbf | 0:(1/16):((2^8-1)/16) : to be discussed |
| | **reserved** | 5 | uimsbf | |
| | } | | | |
| | for ( i=0; i<NofCHN; i++ ) { | | | Configurations for GAO_CHN_HDR |
| | if ( **isSame** = 0xFF ) | 8 | uimsbf | 0xFF represents same as previous |
| | { | | | |
| | continue; | | | |
| | } | | | |
| | chn[i].yaw = isSame << 2 + **yaw** | 1 | uimsbf | 0~360 |
| | **chn[i].pitch** | 9 | uimsbf | 0~360 |
| | **chn[i].roll** | 9 | uimsbf | 0~360 |
| | **chn[i].gain** | 8 | uimsbf | 0:(1/16):((2^8-1)/16) : to be discussed |
| | **reserved** | 5 | uimsbf | |
| | } | | | |
| **GaoAttachMetaExtension (1+byteMetaExtension Byte)** | **byteMetaExtension** | 8 | uimsbf | reserved for byte alignment |
| | **dataMetaExtension** | byteHdrExtension x 8 | uimsbf | reserved for Room Property Header |
| | } | | | |
| | } | | | |

*FIG. 16B*

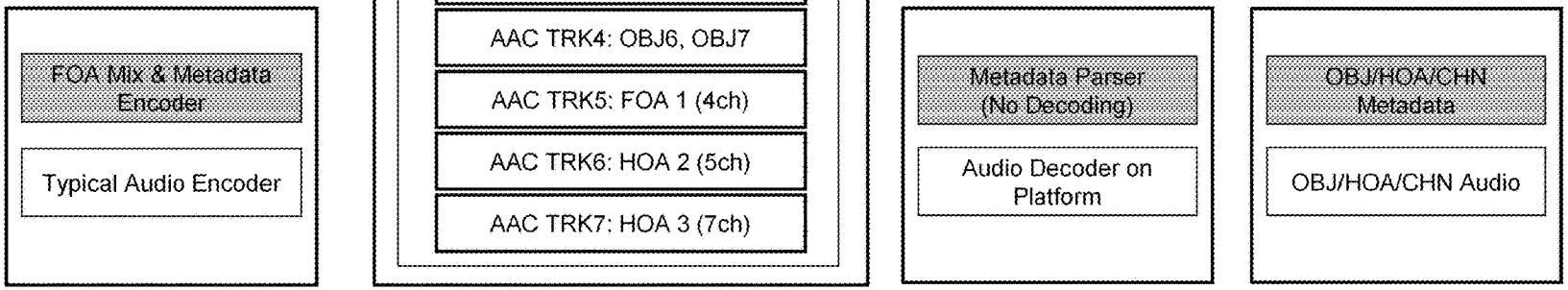
Encoder
*FIG. 17A*
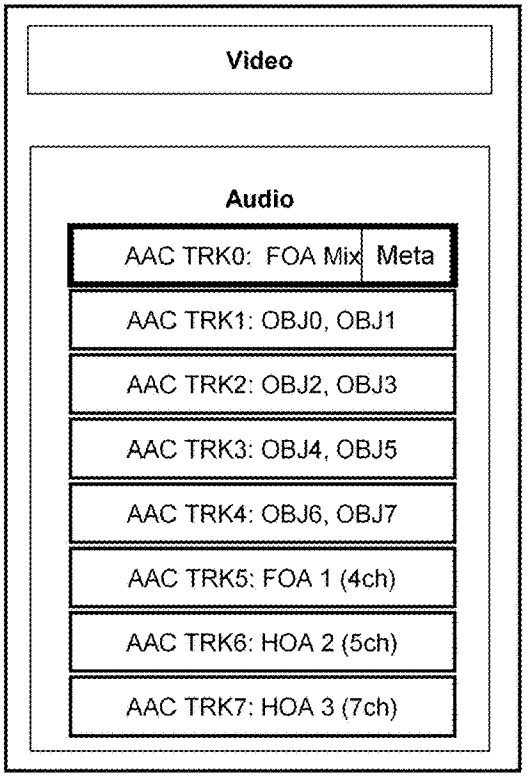
MP4 file
*FIG. 17B*
Decoder
*FIG. 17C*
Renderer
*FIG. 17D*

METHOD AND DEVICE FOR PROCESSING AUDIO SIGNAL BY USING METADATA

CROSS-REFERENCE TO RELATED APPLICATIONS

This application claims the priority to Korean Patent Application No. 10-2016-0122515 filed in the Korean Intellectual Property Office on Sep. 23, 2016 and Korean Patent Application No. 10-2017-0018515 filed in the Korean Intellectual Property Office on Feb. 10, 2017, the entire contents of which are incorporated herein by reference.

TECHNICAL FIELD

The present disclosure relates to an audio signal processing method and device. More specifically, the present disclosure may relate to a binaural audio signal processing method and device.

BACKGROUND ART 3D audio commonly refers to a series of signal processing, transmission, encoding, and playback techniques for providing a sound which gives a sense of presence in a three-dimensional space by providing an additional axis corresponding to a height direction to a sound scene on a horizontal plane (2D) provided by conventional surround audio. In particular, to provide 3D audio, a rendering technique for forming a sound image at a virtual position where a speaker does not exist even if a larger number of speakers or a smaller number of speakers than that for a conventional technique are used may be needed.

3D audio is expected to become an audio solution to an ultra high definition TV (UHDTV), and is expected to be applied to various fields of theater sound, personal 3D TV, tablet, wireless communication terminal, and cloud game in addition to sound in a vehicle evolving into a high-quality infotainment space.

Meanwhile, a sound source provided to the 3D audio may include a channel-based signal and an object-based signal. Furthermore, the sound source may be a mixture type of the channel-based signal and the object-based signal, and, through this configuration, a new type of listening experience may be provided to a user.

Binaural rendering is performed to model such a 3D audio into signals to be delivered to both ears of a human being. A user may experience a sense of three-dimensionality from a binaural-rendered 2-channel audio output signal through a headphone, an earphone, or the like. A specific principle of the binaural rendering is described as follows. A human being listens to a sound through two ears, and recognizes the location and the direction of a sound source from the sound. Therefore, if a 3D audio can be modeled into audio signals to be delivered to two ears of a human being, the three-dimensionality of the 3D audio can be reproduced through a 2-channel audio output without a large number of speakers.

DISCLOSURE

Technical Problem

Some embodiments of the present disclosure provides an audio signal processing method and device for processing an audio signal.

Some embodiments of the present disclosure also provides an audio signal processing method and device for processing a binaural audio signal.

Some embodiments of the present disclosure also provides an audio signal processing method and device for processing a binaural audio signal using metadata.

Some embodiments of the present disclosure may also provide an audio signal processing method and device for processing an audio signal using an audio file format that supports a smaller number of channels than the number of channels of the audio signal.

Technical Solution

In accordance with an exemplary embodiment of the present disclosure, an audio signal processing device for rendering an audio signal may include: a receiving unit configured to receive the audio signal; a processor configured to determine whether to render the audio signal by reflecting a location of a sound image simulated by the audio signal on the basis of metadata for the audio signal, and render the audio signal according to a result of the determination; and an output unit configured to output the rendered audio signal.

In an embodiment, the metadata may include sound level information indicating a sound level corresponding to a time interval indicated by the metadata. Here, the processor may determine whether to render the audio signal by reflecting the location of the sound image simulated by the audio signal, on the basis of the sound level information.

In an embodiment, the processor may compare a sound level of the audio signal corresponding to a first time interval with a sound level of the audio signal corresponding to a second time interval to determine whether to render the audio signal corresponding to the second time interval by reflecting a location of a sound image simulated by the audio signal corresponding to the second time interval. Here, the first time interval may be prior to the second time interval.

In an embodiment, the processor may determine whether to render the audio signal by reflecting the location of the sound image simulated by the audio signal, on the basis of whether a sound level indicated by the sound level information is smaller than a pre-designated value.

In an embodiment, the metadata may include binaural effect level information indicating a level of application of binaural rendering. The processor may determine the binaural rendering application level for the audio signal on the basis of the binaural effect level information, and may binaurally render the audio signal with the determined binaural rendering application level.

In an embodiment, the processor may change a level of application of a head related transfer function (HRFT) or a binaural rendering impulse response (BRIR) for binaural rendering according to the determined binaural rendering application level.

In an embodiment, the binaural effect level information may indicate the level of binaural rendering for each component of the audio signal.

In an embodiment, the binaural effect level information may indicate the level of binaural rendering on a frame-by-frame basis.

In an embodiment, the metadata may include motion application information indicating whether to render the audio signal by reflecting a motion of a listener. Here, the processor may determine whether to render the audio signal by reflecting the motion of the listener, on the basis of the motion application information.

In an embodiment, the processor may render the audio signal by applying a fade-in/fade-out effect according to whether determination on whether to perform rendering by applying the location of the sound image simulated by the audio signal is changed.

In an embodiment, the metadata may include personalization parameter application information indicating whether to allow application of a personalization parameter which may be set according to the listener. Here, the processor may render the audio signal without applying the personalization parameter according to the personalization parameter application information.

In accordance with another exemplary embodiment of the present disclosure, an audio signal processing device for processing an audio signal to transfer the audio signal may include: a receiving unit configured to receive the audio signal; a processor configured to generate metadata for the audio signal, the metadata including information for reflecting a location of a sound image simulated by the audio signal; and an output unit configured to output the metadata.

In an embodiment, the processor may insert, into the metadata, a sound level corresponding to a time interval indicated by the metadata. Here, the sound level may be used to determine whether to render the audio signal by reflecting the location of the sound image simulated by the audio signal.

In an embodiment, the processor may insert, into the metadata, binaural effect level information indicating a level of binaural rendering which is applied to the audio signal.

In an embodiment, the binaural effect level information may be used to change a level of application of a head related transfer function (HRFT) or a binaural rendering impulse response (BRIR) for the binaural rendering.

In an embodiment, the binaural effect level information may indicate the level of binaural rendering for each audio signal component of the audio signal.

In an embodiment, the binaural effect level information may indicate the level of application of binaural rendering on a frame-by-frame basis.

In an embodiment, the processor may insert, into the metadata, motion application information indicating whether to render the audio signal by reflecting a motion of a listener. The motion of the listener may include a head motion of the listener.

In accordance with another exemplary embodiment of the present disclosure, a method for operating an audio signal processing device for rendering an audio signal may include: receiving an audio signal; rendering the audio signal by reflecting a location of a sound image simulated by the audio signal on the basis of metadata for the audio signal; and outputting the rendered audio signal.

In accordance with another exemplary embodiment of the present disclosure, an audio signal processing device for rendering an audio signal may include: a receiving unit configured to receive an audio file including an audio signal; a processor configured to simultaneously render a first audio signal component included in a first track of the audio file and a second audio signal component included in a second track of the audio file; and an output unit configured to output the rendered first audio signal component and the rendered second audio signal component.

In an embodiment, the number of channels supported by each of the first track and the second track may be smaller than a total number of channels of the audio signal.

In an embodiment, the first track may be a track included in a pre-designated location among a plurality of tracks of the audio file.

In an embodiment, the first audio signal component may be able to be rendered without metadata for indicating a location of a sound image simulated by the audio signal.

In an embodiment, the first audio signal component may be able to be rendered without metadata for binaural rendering.

In an embodiment, the first track may include metadata. Here, the processor may determine, on the basis of the metadata, which track of the audio file among a plurality of tracks of the audio file includes an audio signal component.

In an embodiment, the processor may render the first audio signal component and the second audio signal component on the basis of the metadata.

In an embodiment, the processor may check whether the plurality of tracks of the audio file include an audio signal component of the audio signal, in a pre-designated track order.

In an embodiment, the processor may select the first audio signal component and the second audio signal component among a plurality of audio signal components included in a plurality of tracks of the audio file, according to a capability of the audio signal processing device.

In accordance with another exemplary embodiment of the present disclosure, an audio signal processing device for processing an audio signal to transfer the audio signal may include: a receiving unit configured to receive the audio signal; a processor configured to generate an audio file including a first audio signal component of the audio signal in a first track and a second audio signal component of the audio signal in a second track; and an output unit configured to output the audio file.

In an embodiment, the number of channels supported by each of the first track and the second track may be smaller than a total number of channels of the audio signal.

In an embodiment, the first track may be a track included in a pre-designated location among a plurality of tracks of the audio file.

In an embodiment, the first audio signal component may be able to be rendered without metadata for indicating a location of a sound image simulated by the audio signal.

In an embodiment, the first audio signal component may be able to be rendered without metadata for binaural rendering.

In an embodiment, the processor may insert metadata into the first track, wherein the metadata may indicate a track including an audio signal component of the audio signal among a plurality of tracks of the audio file.

In an embodiment, the processor may insert a plurality of audio signal components of the audio signal into the plurality of tracks of the audio file in a pre-designated order.

Advantageous Effects

Some embodiments of the present disclosure may provide an audio signal processing method and device for processing a plurality of audio signals.

For example, some exemplary embodiments of the present disclosure may provide an audio signal processing method and device for processing an audio signal expressible as an ambisonic signal.

DESCRIPTION OF DRAWINGS

FIGS. 3A, 3B and 3C illustrate a syntax of metadata indicating a level of application of binaural rendering according to an embodiment of the present disclosure;

FIG. 4 illustrates a syntax of metadata for adjusting a rendering condition according to characteristics of a device in which an audio signal is rendered according to an embodiment of the present disclosure;

FIG. 7 illustrates a specific format of GAO_HDR according to an embodiment of the present disclosure;

FIGS. 15A to 16B illustrate a syntax of an AAC file according to an embodiment of the present disclosure;

FIG. 17A to 17D illustrate a method for processing an audio signal using an audio file format that supports a smaller number of channels than the number of channels included in an audio signal according to an embodiment of the present disclosure;

MODE FOR CARRYING OUT THE INVENTION

Figure 1:
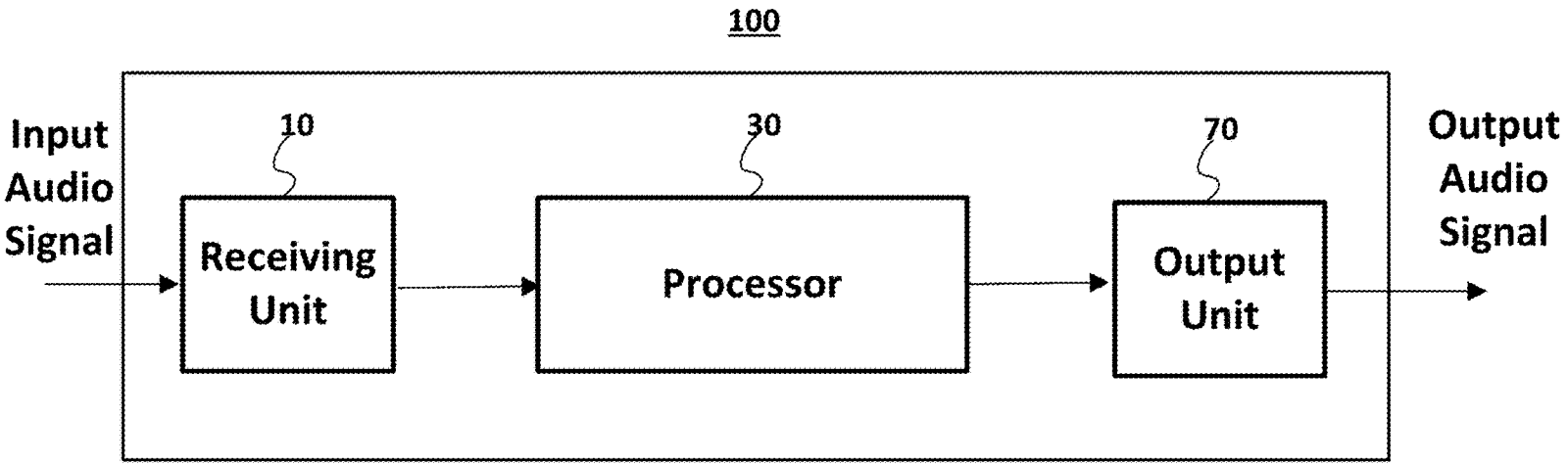
FIG. 1 is a block diagram illustrating an audio signal processing device for rendering an audio signal according to an embodiment of the present disclosure.

Hereinafter, embodiments of the present invention will be described in detail with reference to the accompanying drawings so that the embodiments of the present invention can be easily carried out by those skilled in the art. However, the present invention may be implemented in various different forms and is not limited to the embodiments described herein. Some parts of the embodiments, which are not related to the description, are not illustrated in the drawings in order to clearly describe the embodiments of the present invention. Like reference numerals refer to like elements throughout the description.

When it is mentioned that a certain part "includes" certain elements, the part may further include other elements, unless otherwise specified.

The present application claims priority of Korean Patent Application Nos. 10-2016-0122515 (2016 Sep. 23) and 10-2017-0018515 (2017 Feb. 10), the embodiments and descriptions of which are deemed to be incorporated herein.

FIG. 1 is a block diagram illustrating an audio signal processing device according to an embodiment of the present disclosure.

The audio signal processing device 100 according to an embodiment of the present disclosure may include a receiving unit 10, a processor 30, and an output unit 70.

The receiving unit 10 may receive an input audio signal. Here, the input audio signal may be a signal obtained by converting a sound collected by a sound collecting device. The sound collecting device may be a microphone. The sound collecting device may be a microphone array including a plurality of microphones.

The processor 30 may process the input audio signal received by the receiving unit 10. For example, the processor 30 may include a format converter, a renderer, and a post-processing unit. The format converter may convert a format of the input audio signal into another format. In some instances, the format converter may convert an object signal into an ambisonic signal. For instance, the ambisonic signal may be a signal recorded through a microphone array. As another example, the ambisonic signal may be a signal obtained by converting a signal recorded through a microphone array into a coefficient for a base of spherical harmonics. In addition, the format converter may convert the ambisonic signal into the object signal. In detail, the format converter may change an order of the ambisonic signal. For example, the format converter may convert a higher order ambisonics (HoA) signal into a first order ambisonics (FoA) signal. Furthermore, the format converter may obtain location information related to the input audio signal, and may convert the format of the input audio signal based on the obtained location information. Here, the location information may be information about a microphone array which has collected a sound corresponding to an audio signal. The information on the microphone array may include, for example, at least one of arrangement information, number information, location information, frequency characteristic information, or beam pattern information of microphones constituting the microphone array. Furthermore, the location information related to the input audio signal may include information indicating a location of a sound source.

The renderer may render the input audio signal. In detail, the renderer may render the format-converted input audio signal. Here, the input audio signal may include at least one of a loudspeaker channel signal, an object signal, or an ambisonic signal. In an embodiment, the renderer may render, by using information indicated by an audio signal format, the input audio signal into an audio signal that enables the input audio signal to be represented by a virtual sound object located in a three-dimensional space. For example, the renderer may render the input audio signal in association with a plurality of speakers. Furthermore, the renderer may binaurally render the input audio signal.

Furthermore, the renderer may include a time synchronizer which synchronizes times of an object signal and an ambisonic signal.

Furthermore, the renderer may include a 6-degrees-of-freedom (6DOF) controller which controls the 6DOF of an ambisonic signal. The 6DOF controller may include a direction modification unit which changes a magnitude of a specific directional component of the ambisonic signal. In detail, the 6DOF controller may change the magnitude of the specific directional component of the ambisonic signal according to the location of a listener in a virtual space simulated by an audio signal. The direction modification unit may include a directional modification matrix generator which generates a matrix for changing the magnitude of a specific directional component of the ambisonic signal. Furthermore, the 6DOF controller may include a conversion unit which converts the ambisonic signal into a channel signal. In an embodiment, the 6DOF controller may include a relative position calculation unit which calculates a relative position between a listener of the audio signal and a virtual speaker corresponding to the channel signal.

The output unit 70 outputs the rendered audio signal. In an embodiment, the output unit 70 may output the audio signal through at least two loudspeakers. In another specific embodiment, the output unit 70 may output the audio signal through a 2-channel stereo headphone.

The audio signal processing device 100 may concurrently process an ambisonic signal and an object signal. Specific operation of the audio signal processing device 100 will be described with reference to FIG. 2.

Figure 2:
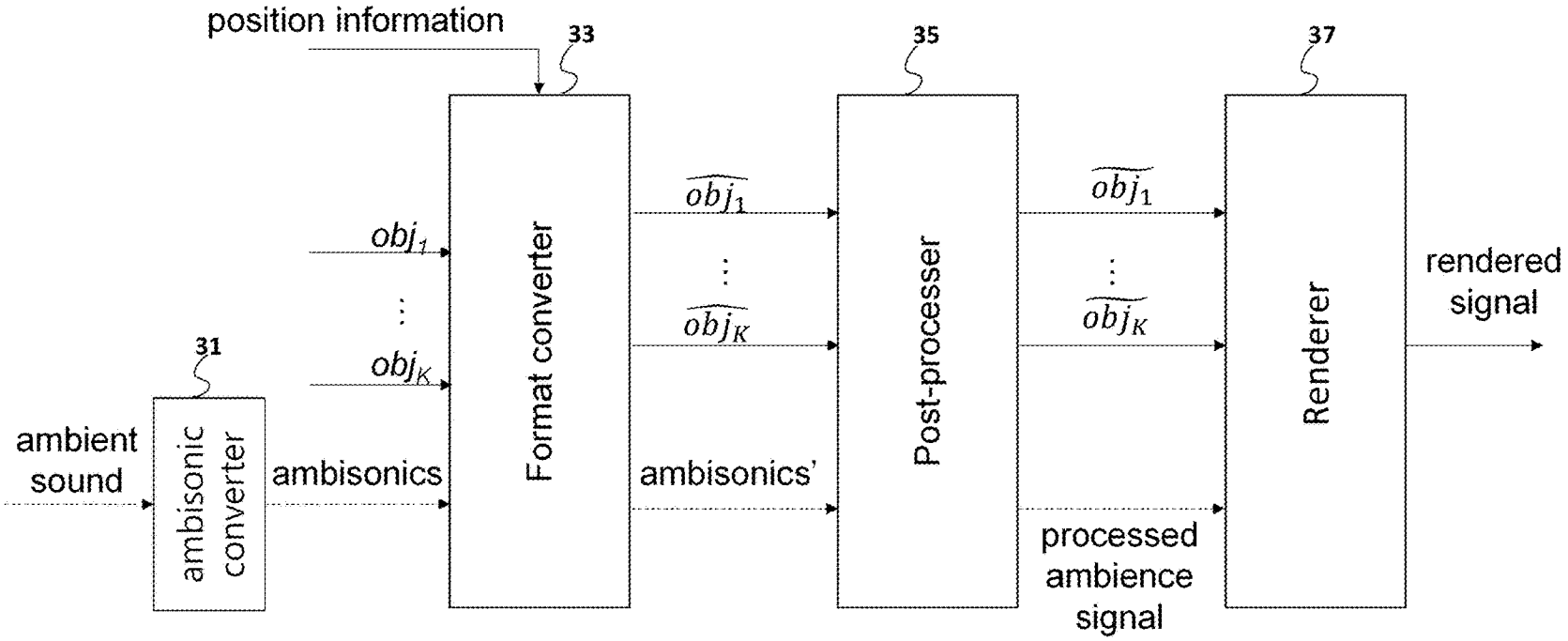
FIG. 2 is a block diagram illustrating that an audio signal processing device for rendering an audio signal according to an embodiment of the present disclosure concurrently processes an ambisonic signal and an object signal.

FIG. 2 is a block diagram illustrating an audio signal processing device concurrently processing an ambisonic signal and an object signal according to an embodiment of the present disclosure.

The above-mentioned ambisonics is one of methods for enabling the audio signal processing device to obtain information on a sound field and reproduce a sound by using the obtained information. In detail, the ambisonics may represent that the audio signal processing device processes an audio signal as below.

For ideal processing of an ambisonic signal, the audio signal processing device is required to obtain information on sound sources from sounds of all directions which are incident to one point in a space. However, since there is a limit in reducing a size of a microphone, the audio signal processing device may obtain the information on the sound source by calculating a signal incident to an infinitely small dot from a sound collected from a spherical surface, and may use the obtained information. For instance, in a spherical coordinate system, a location of each microphone of the microphone array may be represented by a distance from a center of the coordinate system, an azimuth (or horizontal angle), and an elevation angle (or vertical angle). The audio signal processing device may obtain a base of spherical harmonics using a coordinate value of each microphone in the spherical coordinate system. Here, the audio signal processing device may project a microphone array signal into a spherical harmonics domain based on each base of spherical harmonics.

For example, the microphone array signal may be recorded through a spherical microphone array. When the center of the spherical coordinate system is matched to a center of the microphone array, a distance from the center of the microphone array to each microphone is constant. Therefore, the location of each microphone may be represented by an azimuth θ and an elevation angle ϕ. Provided that the location of qth microphone of the microphone array is (θq, ϕq), a signal pa recorded through the microphone may be represented as the following equation in the spherical harmonics domain.

$$p_a(\theta_q, \phi_q) = \sum_{m=0}^{\infty} \sum_{n=-m}^{m} B^{nm} Y^{nm}(\theta_q, \phi_q) \quad \text{[Equation 1]}$$

pa denotes a signal recorded through a microphone. (θq, ϕq) denotes the azimuth and the elevation angle of the qth microphone. Y denotes a spherical harmonics function having an azimuth and an elevation angle as factors. m denotes an order of the spherical harmonics function, and n denotes a degree. B denotes an ambisonic coefficient corresponding to the spherical harmonics function. In the present disclosure, the ambisonic coefficient may be referred to as an ambisonic signal. In detail, the ambisonic signal may represent either an FoA signal or an HoA signal.

Here, the audio signal processing device may obtain the ambisonic signal using a pseudo inverse matrix of a spherical harmonics function. In an exemplary embodiment, the audio signal processing device may obtain the ambisonic signal using the following equation.

$$p_a = YB \Leftrightarrow B = p\mathrm{inv}(Y)p_a \quad \text{[Equation 2]}$$

As described above, pa denotes a signal recorded through a microphone, and B denotes an ambisonic coefficient corresponding to a spherical harmonics function. pinv(Y) denotes a pseudo inverse matrix of Y.

The above-mentioned object signal may represent an audio signal corresponding to a single sound object. In detail, the object signal may be a signal obtained by a device collecting a sound near a specific sound object. Unlike an ambisonic signal that represents, in a space, all sounds collectable at a specific point, the object signal is used to represent that a sound output from a certain single sound object is delivered to a specific point. The audio signal processing device may represent the object signal in a format of an ambisonic signal using a location of a sound object corresponding to the object signal. In one embodiment, the audio signal processing device may measure the location of the sound object using an external sensor installed in a microphone which collects a sound corresponding to the sound object and an external sensor installed on a reference point for location measurement. In another embodiment, the audio signal processing device may analyze an audio signal collected by a microphone to estimate the location of the sound object. In detail, the audio signal processing device may represent the object signal as an ambisonic signal using the following equation.

$$B_{nm}^{S} = SY(\theta_S, \phi_S) \quad \text{[Equation 3]}$$

θs and ϕs respectively denote an azimuth and an elevation angle representing the location of a sound object corresponding to an object. Y denotes spherical harmonics having an azimuth and an elevation angle as factors. $B_{nm}^{S}$ denotes an ambisonic signal converted from an object signal.

Therefore, when the audio signal processing device simultaneously process an object signal and an ambisonic signal, the audio signal processing device may use at least one of the following exemplary methods. In one embodiment, the audio signal processing device may separately output the object signal and the ambisonic signal. The audio signal processing device may convert the object signal into an ambisonic signal format to output the ambisonic signal and the object signal converted into the ambisonic signal format. For example, the ambisonic signal and the object signal converted into the ambisonic signal format may be HoA signals. Alternatively, the ambisonic signal and the object signal converted into the ambisonic signal format may be FoA signals. In another specific embodiment, the audio signal processing device may output only the ambisonic signal without the object signal. For instance, the ambisonic signal may be FoA signals. Assuming that the ambisonic signal includes all sounds collected from one point in a space, the ambisonic signal may include signal components corresponding to the object signal. Therefore, the audio signal processing device may reproduce a sound object corresponding to the object signal by processing only the ambisonic signal without processing the object signal in the manner of the above-mentioned embodiment.

In an exemplary embodiment, the audio signal processing device may process the ambisonic signal and the object signal in the manner of the embodiment of FIG. 2. An ambisonic converter 31 may convert an ambient sound into the ambisonic signal. A format converter 33 may change the formats of the object signal and the ambisonic signal. Here, the format converter 33 may convert the object signal into the ambisonic signal format. For example, the format converter 33 may convert the object signal into HoA signals. Furthermore, the format converter 33 may convert the object signal into FoA signals. Additionally, the format converter 33 may convert an HoA signal into an FoA signal. A post-processor 35 may post-processes a format-converted audio signal. A renderer 37 may render the post-processed audio signal. The renderer 37 may be a binaural render. Therefore, a renderer 37 may binaurally render the post-processed audio signal.

The audio signal processing device may render an audio signal to simulate a sound source located in a virtual space. Here, the audio signal processing device may require information for rendering the audio signal. The information for rendering the audio signal may be transferred in a format of metadata, and the audio signal processing device may render the audio signal on the basis of the metadata. In particular, the metadata may include information about a rendering method intended by a content producer and information about a rendering environment. Accordingly, the audio signal processing device may reflect an intention of the content producer to render the audio signal. The type and format of the metadata will be described with reference to FIGS. 3A to 16B.

FIGS. 3A, 3B and 3C illustrate a syntax of metadata indicating a level of application of binaural rendering according to an embodiment of the present disclosure.

Metadata may include head motion application information indicating whether to render an audio signal by reflecting a head motion of a listener when rendering the audio signal. Here, the audio signal processing device which renders the audio signal may obtain the head motion application information from the metadata. The audio signal processing device may determine whether to render an object signal by reflecting the head motion of the listener, on the basis of the head motion application information. The head motion may represent head rotation. The audio signal processing device may render the object signal without reflecting the head motion of the listener according to the head motion application information. Alternatively, the audio signal processing device may render the object signal by reflecting the head motion of the listener according to the head motion application information. There may exist an object that moves with the head of the listener, such as a bee adhering to the head of the listener. Even when the head of the listener rotates, a relative distance to the listener may not change or may change slightly. Therefore, the audio signal processing device may render an audio signal for simulating the corresponding object without reflecting the head motion of the listener. This exemplary embodiment may reduce the amount of calculation by the audio signal processing device.

Furthermore, metadata may include binaural effect level information indicating a level of application of binaural rendering. Here, the audio signal processing device which renders an audio signal may obtain a binaural effect level from the metadata. Furthermore, the audio signal processing device may determine a level of application of binaural rendering to an object signal on the basis of the binaural effect level information. In detail, the audio signal processing device may determine whether to apply binaural rendering to an audio signal on the basis of the binaural effect level information. As described above, when the audio signal processing device binaurally renders an audio signal, the audio signal processing device may perform simulation as if a sound image represented by the audio signal is located in a three-dimensional space. However, since a transfer function such as a head related transfer function (HRTF) or binaural room impulse response (BRIR) is used for the binaural rendering, a sound tone of the audio signal may be changed due to the binaural rendering. Furthermore, a sense of space may be more important than a sound tone depending on the type of the sound image represented by the audio signal. Therefore, a producer of content included in the audio signal may set the binaural effect level information to determine the level of application of binaural rendering to the audio signal. In detail, the binaural effect level information may indicate non-application of binaural rendering. In this case, the audio signal processing device may render an audio signal without using binaural rendering according to the binaural effect level information. Furthermore, the binaural effect level information may indicate the level of application of the HRTF or BRIR for binaural rendering when the binaural rendering is applied.

In one embodiment, the binaural effect level information may be divided into quantized levels. In another embodiment, the binaural effect level information may be divided into three levels such as 'mild', 'normal', and 'strong'. In another still embodiment, the binaural effect level information may be divided into five levels as illustrated in FIG. 3A. In another still embodiment, the binaural effect level information may be expressed as any one value among consecutive real numbers between 0 and 1.

The audio signal processing device which renders an audio signal may apply the binaural effect level information for each audio track included in the audio signal. Furthermore, the audio signal processing device may apply the binaural effect level information for each audio source included in the audio signal. Additionally, the audio signal processing device which renders the audio signal may apply the binaural effect level information for each signal characteristic. In addition, the audio signal processing device may apply the binaural effect level information for each object included in the audio signal. Furthermore, the audio signal processing device which renders the audio signal may apply the binaural effect level information for each time interval of each audio track. Here, the time interval may be a frame of an audio signal. In detail, the metadata may have the binaural effect level information for each track and each frame as illustrated in FIG. 3B.

Furthermore, metadata may include binaural effect enforcement information indicating whether the binaural effect level information is forcibly applied. The audio signal processing device which renders an audio signal may obtain the binaural effect level enforcement information from the metadata, and may selectively apply the binaural effect level information according to the binaural effect level enforcement information. Furthermore, the audio signal processing device may forcibly apply the binaural effect level information according to the binaural effect level enforcement information. The audio signal processing device which renders an audio signal may apply the binaural effect level enforcement information to each audio track included in the audio signal. Furthermore, the audio signal processing device which renders an audio signal may apply the binaural effect level enforcement information for each audio source included in the audio signal. Furthermore, the audio signal processing device may apply the binaural effect level enforcement information to each signal characteristic. Furthermore, the audio signal processing device which renders an audio signal may apply the binaural effect level enforcement information to each object included in the audio signal. Furthermore, the audio signal processing device which renders an audio signal may apply the binaural effect level enforcement information for each time interval of each audio track. In an exemplary embodiment, the binaural effect level enforcement information may have a format as illustrated in FIG. 3C.

The audio signal processing device which renders an audio signal may use the binaural effect level information to determine whether to apply not only binaural rendering but also other stereophonic sounds. In detail, the audio signal processing device may render an audio signal indicated by the binaural effect level information according to the binaural effect level information without reflecting a location of a sound image simulated by the audio signal. In these embodiments, the efficiency of calculation by the audio signal processing device which renders an audio signal may be improved. Furthermore, through these embodiments, a content experience intended by a producer of content included in an audio signal may be accurately delivered to a listener.

Even the same audio signal may be rendered through various devices. As content is consumed through various image display devices, rendering environments for audio signals become various. For example, the same audio signal may be rendered by a head mounted display (HMD)-type virtual reality (VR) device or may be rendered by a cell phone or a TV. Therefore, it may be necessary to differently render an audio signal according to a device in which the audio signal is rendered. This operation will be described with reference to FIG. 4.

FIG. 4 illustrates a syntax of metadata for adjusting a rendering condition according to a characteristic of a device in which an audio signal is rendered according to an embodiment of the present disclosure.

Metadata may include a reference device characteristic parameter indicating a characteristic of an audio signal device which is a criterion for generating the metadata. In detail, the reference device characteristic parameter may indicate the characteristic of an audio signal processing device intended to render an audio signal by a producer of content included in the audio signal.

The reference device characteristic parameter may include the characteristic of an image display device in which an audio signal is rendered. In detail, the reference device characteristic parameter may include a screen characteristic of the image display device. The screen characteristic may include, for example, at least one of a screen type, a screen resolution, a screen size, or a screen aspect ratio. The screen type may include at least one of a TV, a PC monitor, a cell phone, or an HMD. Furthermore, the screen type may be combined with a screen resolution. For example, the reference device characteristic parameter may differently indicate an HMD supporting high definition (HD) resolution and an HMD supporting ultra high definition (UHD) resolution. The screen aspect ratio may include at least one of 1:1, 4:3, 15:9, or 16:9. Furthermore, the reference device characteristic parameter may include a specific model name.

Furthermore, the reference device characteristic parameter may include a positional relationship between a listener and an image display device. The positional relationship between the listener and the image display device may include a distance between the listener and a screen of the image display device. Furthermore, the positional relationship between the listener and the image display device may include a viewing angle at which the listener views the image display device. The distance between the listener and the screen of the image display device may vary with a production environment when producing audio content. And, the reference device characteristic parameter may differently indicate a viewing angle such as 90 degrees or less, 90 to 110 degrees, 110 to 130 degrees, and 130 degrees or more.

Furthermore, the reference device characteristic parameter may include an audio signal output characteristic. For example, the audio signal output characteristic may include at least one of a loudness level, an output device type, or an EQ which is used for output. The reference device characteristic parameter may express the loudness level as a sound pressure level (SPL) value. In an embodiment, the reference device characteristic parameter may indicate a range of the loudness level intended by the metadata. In another embodiment, the reference device characteristic parameter may indicate a value of the loudness level intended by the metadata. The output device type may include at least one of a headphone or a speaker. Furthermore, the output device type may be subdivided according to an output characteristic of a headphone or a speaker. The EQ which is used for output may be an EQ used when a producer created content. In detail, the reference device characteristic parameter may have a syntax as illustrated in FIG. 4.

The audio signal processing device may render an audio signal on the basis of a difference between the reference device characteristic parameter and the characteristic of the audio signal processing device. In an embodiment, the audio signal processing device may adjust the magnitude of the audio signal on the basis of a difference between the distance between a listener and a screen of an image output device indicated by the reference device characteristic parameter and the distance between the listener and the screen of the image output device indicated by an actual device characteristic parameter. In another embodiment, the audio signal processing device may render the audio signal by correcting the location of a sound image indicated by metadata on the basis of a difference between a viewing angle indicated by the reference device characteristic parameter and a viewing angle indicated by an actual device characteristic parameter. In another still embodiment, the audio signal processing device may adjust an output level of the audio signal processing device on the basis of a loudness level indicated by the reference device characteristic parameter. For example, the audio signal processing device may adjust the output level of the audio signal processing device to the loudness level indicated by the reference device characteristic parameter. In another still embodiment, the audio signal processing device may display, to a user, the loudness level indicated by the reference device characteristic parameter. Furthermore, the audio signal processing device may adjust the output level of the audio signal processing device on the basis of the loudness level indicated by the reference device characteristic parameter and an equal loudness contour.

The audio signal processing device may select one of a plurality of reference device characteristic parameter sets and may use metadata corresponding to the selected reference device characteristic parameter set to render an audio signal. For example, the audio signal processing device may select one of the plurality of reference device characteristic parameter sets on the basis of the characteristics of the audio signal processing device. Here, the reference device characteristic parameter sets may include at least one of the above-mentioned parameters. Furthermore, the audio signal processing device may receive the plurality of reference device characteristic parameter sets and a metadata set including metadata respectively corresponding to the plurality of reference device characteristic parameter sets. Here, the metadata set may include a screen optimization information number numScreenOptimizedInfo indicating the number of reference device characteristic parameter sets. The screen optimization information number may be expressed with five bits, and may indicate up to 32.

The audio signal processing device may binaurally render an audio signal using a personalization parameter. Here, the personalization parameter may represent a parameter that may be set according to a listener. For instance, the personalization parameter may include at least one of an HRTF, body information, or a 3D model. The personalization parameter may affect audio signal rendering. Therefore, when the personalization parameter set by the listener is applied, an intention of a producer of content included in an audio signal may not be reflected in a rendered audio. As a result, a content experience to be delivered by the audio signal through content may not be delivered. Therefore, metadata may include personalization application information indicating whether to apply the personalization parameter. The audio signal processing device may determine whether to binaurally render an audio signal by applying the personalization parameter on the basis of the personalization application information. When the personalization application information indicates non-permission of application of the personalization parameter, the audio signal processing device may binaurally render an audio signal without applying the personalization parameter.

A producer of content included in an audio signal may induce optimization of the amount of calculation by the audio signal processing device by using metadata. In detail, the metadata may include sound level information indicating a sound level of an audio signal. The audio signal processing device may render the audio signal without reflecting the location of a sound image simulated by the audio signal on the basis of the sound level information. Rendering the audio signal without reflecting the location of the sound image simulated by the audio signal may include rendering the audio signal without applying binaural rendering.

In an embodiment, the metadata may include mute information indicating that the sound level is 0. Here, the audio signal processing device may render an audio signal without reflecting the location of the sound image simulated by the audio signal on the basis of the mute information. In detail, the audio signal processing device may render an audio signal, for which the mute information indicates that the sound level is 0, without reflecting the location of a sound image simulated by the audio signal.

In another embodiment, the audio signal processing device may render an audio signal having a sound level which is equal to or smaller than a certain value, without reflecting the location of a sound image simulated by the audio signal.

In another still embodiment, the audio signal processing device may render, on the basis of a sound level of an audio signal corresponding to a first time interval and a sound level of an audio signal corresponding to a second time interval, an audio signal corresponding to the second time interval without reflecting the location of a sound image simulated by the audio signal corresponding to the second time interval. Here, the first time interval is prior to the second time interval. Furthermore, the first time interval and the second time interval may be consecutive time intervals. In detail, the audio signal processing device may compare the sound level of the audio signal corresponding to the first time interval with the sound level of the audio signal corresponding to the second time interval to render the audio signal corresponding to the second time interval without reflecting the location of the sound image simulated by the audio signal corresponding to the second time interval. For example, when a difference between the sound level of the audio signal corresponding to the first time interval and the sound level of the audio signal corresponding to the second time interval is equal to or larger than a designated value, the audio signal processing device may render the audio signal corresponding to the second time interval without reflecting the location of the sound image simulated by the audio signal corresponding to the second time interval. When a listener listens to a relatively small sound after listening to a loud sound, the listener may not easily recognize the relatively small sound due to a temporal masking effect. When the listener listens to a relatively small sound after listening to a loud sound, the listener may not easily recognize the location of a sound source that emits the relatively small sound due to a spatial masking effect. Therefore, even if rendering for stereophonic sound reproduction is applied to a small sound that follows a relatively loud sound, the effect of the rendering on the listener may be insignificant. Therefore, the audio signal processing device may not apply the rendering for stereophonic sound reproduction to a small sound that follows a loud sound in order to improve the efficiency of calculation.

In an embodiment, metadata may differentiate sound levels by at least one of an audio track, an audio source, an object, or a time interval. The above-mentioned time interval may be a frame of an audio signal. Furthermore, in the above-mentioned embodiments, the audio signal processing device may render an audio signal by applying a fade-in/fade-out effect according to whether determination on whether to perform rendering by applying the location of a sound image simulated by the audio signal is changed. Through these embodiments, the audio signal processing device may prevent a rendered sound from being unnaturally heard, by selectively applying stereophonic sound rendering.

Furthermore, the metadata may include motion application information indicating whether to render an audio signal by reflecting a motion of a listener with respect to a location of a sound image simulated by the audio signal. The audio signal processing device may obtain the motion application information from the metadata. The audio signal processing device may determine whether to render an object signal by reflecting the motion of the listener, on the basis of the motion application information. For example, the metadata may include head tracking application information indicating whether to render an audio signal by reflecting a head motion of the listener. Here, the audio signal processing device may obtain the head tracking application information from the metadata. The audio signal processing device may determine whether to render an object signal by reflecting the head motion of the listener, on the basis of the head tracking application information. The audio signal processing device may render an object signal without reflecting the head motion of the listener, on the basis of the head tracking application information. In the case of an object that moves with the head of the listener, such as a bee adhering to the head of the listener, a change of a relative position of the object may not occur or may be very small. Therefore, for an audio signal indicating such an object, the audio signal processing device may render the audio signal for simulating the object without reflecting the head motion of the listener.

The audio signal processing device may optimize the efficiency of calculation using metadata according to the above-mentioned embodiments.

A specific structure and format of the metadata will be described with reference to FIGS. 5 to 8.

Figure 5:
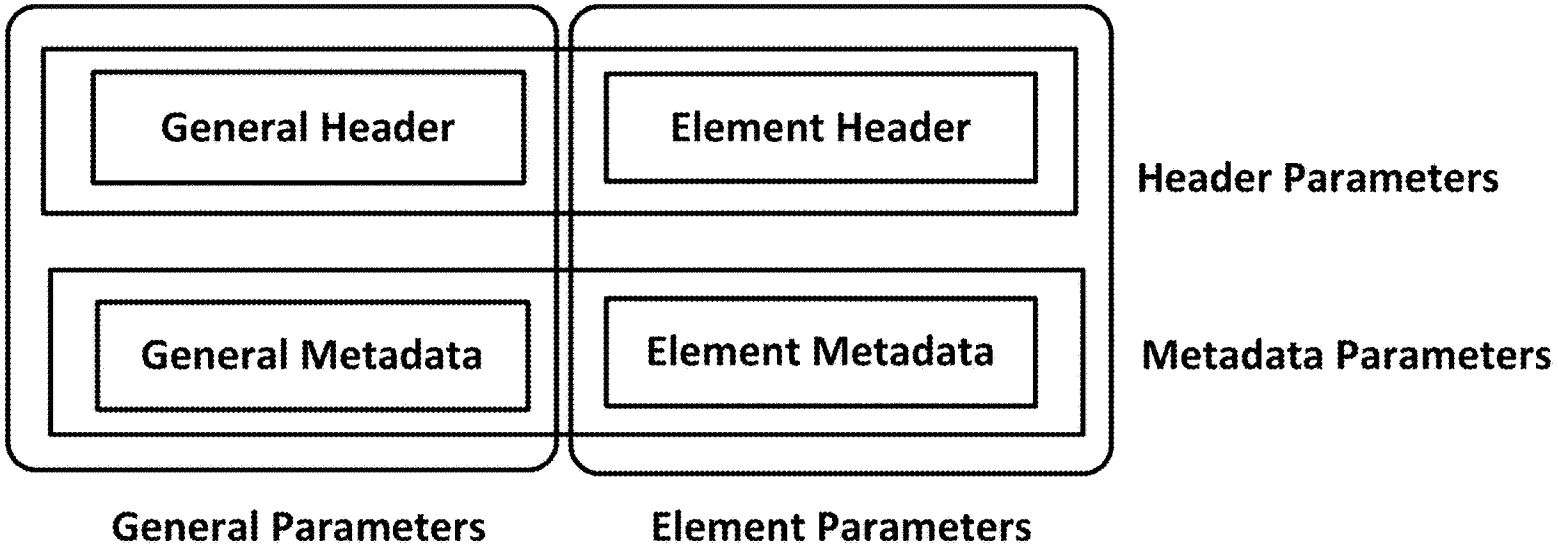
FIG. 5 illustrates classification of additional information according to an embodiment of the present disclosure.

FIG. 5 illustrates classification of additional information according to an embodiment of the present disclosure.

Additional information may include metadata. The additional information may be divided according to a relative length of a time interval of an audio signal signaled by the additional information. For instance, the additional information may be divided into a header parameter and a metadata parameter according to the relative length of the time interval of the audio signal signaled by the additional information. The header parameter may include a parameter which is less likely to vary frequently when rendering an audio signal. The parameter included in the header parameter may be information which remains unchanged until content included in an audio signal is ended or a rendering configuration is changed. For example, the header parameter may include an order of an ambisonic signal. The metadata parameter may include a parameter which is highly likely to vary frequently when rendering an audio signal. For example, the metadata parameter may include information about the location of an object simulated by an audio signal. The information about the location of the object may be, for instance, at least one of an azimuth, an elevation, or a distance.

Furthermore, the types of the additional information may be classified into an element parameter including information for rendering an audio signal and a general parameter including information other than information about an audio signal itself. In detail, the general parameter may include information about an audio signal itself.

Exemplary embodiments of specific structures and formats of a header parameter will be described with reference to FIGS. 6 and 7.

Figure 6:
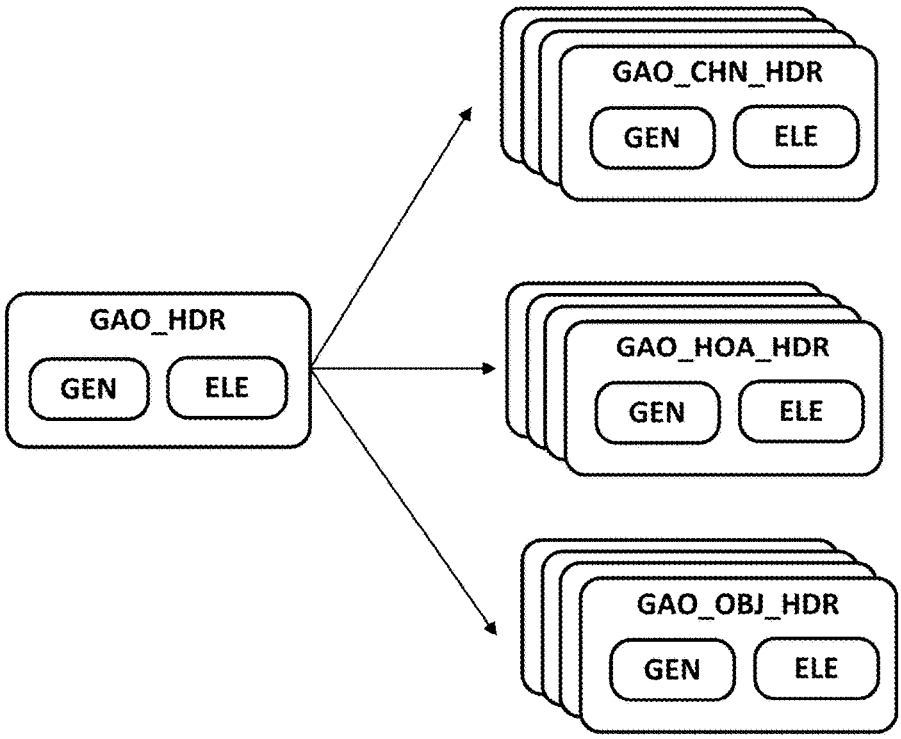
FIG. 6 illustrates a structure of a header parameter according to an embodiment of the present disclosure.

FIG. 6 illustrates a structure of a header parameter according to an embodiment of the present disclosure.

A header parameter may include information for each of types of components included in an audio signal. For example, the header parameter may include information for each of an entire audio signal, an ambisonic signal, an object signal, and a channel signal. In detail, the header parameter indicating the entire audio signal may be referred to as GAO_HDR.

GAO_HDR may include information about a sampling rate of an audio signal. The audio signal processing device may calculate a HRTF-based or BRIR-based filter coefficient on the basis of the information about the sampling rate of the audio signal. If a filter coefficient corresponding to a sampling rate does not exist when binaurally rendering an audio signal, the audio signal processing device may calculate the filter coefficient by resampling the audio signal. When an audio signal includes the information about a sampling rate, such as a WAV file or an AAC file, GAO_HDR may not include the information about a sampling rate.

Furthermore, GAO_HDR may include information indicating a length for each frame indicated by element metadata. The length for each frame may be set on the basis of various constraint conditions such as a sound quality, a binaural rendering algorithm, a memory, the calculation amount, and etc. The length for each frame may be set at the time of post-production or encoding. By using the length for each frame, a producer may adjust a time resolution density when an audio signal is rendered.

In addition, GAO_HDR may include the number of components according to the types of components included in an audio signal. For instance, GAO_HDR may include each of the number of ambisonic signals, the number of channel signals, and the number of object audio signals included in an audio signal.

GAO_HDR may include at least one of the pieces of information included in the following table. Here, GEN represents a general parameter, and ELE represents an element parameter.

| Field | Definition | Type |
|---|---|---|
| formatID | Additional information identifier | GEN |
| Version | Version of information for transferring metadata | GEN |
| programDesc | Express, as a character string, description of content included in an audio signal | GEN |
| Fs | Sampling frequency (e.g., 48000, 44100) | GEN |
| samplePerFrame | The number of samples for each frame indicated by element metadata (e.g., 512, 1024) | GEN |
| NofHOA | The number of all ambisonic signal tracks in content | ELE |
| NofCHN | The number of all channel signal tracks in content | ELE |
| NofOBJ | The number of all object signal tracks in content | ELE |

When the number of components according to the types of components indicated by GAO_HDR is at least one, header parameters corresponding to respective components may be transferred to the audio signal processing device together with GAO_HDR. In detail, when the number of components according to the types of components is at least one, GAO_HDR may include the header parameters corresponding to respective components. Further, when the number of components according to the types of components is at least one, GAO_HDR may include link information connecting the header parameters corresponding to respective components.

FIG. 7 illustrates a specific format of GAO_HDR according to an embodiment of the present disclosure.

A header parameter indicating an ambisonic signal may be referred to as GAO_HOA_HDR. GAO_HOA_HDR may include information about a speaker layout to be used when rendering an ambisonic signal. As described above, the audio signal processing device may convert an ambisonic signal into a channel signal and may binaurally render the converted ambisonic signal. Here, the audio signal processing device may convert the ambisonic signal into the channel signal on the basis of the information about a speaker layout. The information about the speaker layout may be a code independent coding point (CICP) index. When the speaker layout is not determined by the information about a speaker layout, the information about the speaker layout may be transferred to the audio signal processing device through a separate file. When the number of speakers on the speaker layout is reduced, the number of sound sources which require binaural rendering is reduced. Therefore, the amount of calculation required for binaural rendering may be adjusted according to the speaker layout.

GAO_HOA_HDR may include information about a binaural rendering mode to be used when the audio signal processing device binaurally renders a corresponding ambisonic signal. The audio signal processing device may binaurally render the corresponding ambisonic signal on the basis of the binaural rendering mode. Here, the binaural rendering mode may indicate either of a mode in which the head motion of the user is applied after channel rendering and a mode in which channel rendering is applied after applying the head motion of the user. Here, the head motion may represent head rotation. For example, the audio signal processing device may apply, to a first ambisonic signal, a rotation matrix corresponding to the head motion to generate a second ambisonic signal, and may channel-render the second ambisonic signal. The audio signal processing device may maintain a sound tone of an ambisonic signal through this rendering mode. Furthermore, the audio signal processing device may convert the first ambisonic signal into a channel signal, and may change the speaker layout of a first channel signal, and then may binaurally render the channel signal. Through this rendering mode, the audio signal processing device may accurately express the location of a sound image simulated by an ambisonic signal. In the case where GAO_HOA_HDR includes the information about a binaural rendering mode, the producer may select the binaural rendering mode according to content characteristics. For example, for a sound of broadband noise such as a vehicle sound, the producer may channel-render an ambisonic signal, and then may apply the head motion to the channel-rendered ambisonic signal. This is because the sound tone is more important than the location of the vehicle sound. In the case where the location of a sound image is important such as a conversation sound, the producer may apply the head motion to an ambisonic signal, and then may channel-render the ambisonic signal to which the head motion has been applied.

GAO_HOA_HDR may include information indicating whether a location of a sound image simulated by an ambisonic signal rotates according to a time change. The information indicating whether the location of the sound image simulated by an audio signal rotates according to the time change may be expressed in a flag form. In the case where the location of the sound image simulated by the audio signal does not rotate according to the time change, the audio signal processing device may continue to use initially obtained information about location rotation of the sound image simulated by the ambisonic signal.

GAO_HOA_HDR may include information indicating a language of content included in an ambisonic signal. The audio signal processing device may selectively render the ambisonic signal on the basis of the information indicating the language included in an audio signal.

In detail, GAO_HOA_HDR may include at least one of the pieces of information included in the following table.

| Field | Definition |
|---|---|
| format | Indicate a format of an ambisonic signal. May be divided into A-Format or B-Format |
| Order | Indicate an order of an ambisonic signal |
| chOrderingType | Indicate in which form of Ambisonics Channel Number (ACN) and Furse-Malham (FUMA) ambisonic channels are ordered |
| virtualCICP | Indicate a CICP index of a speaker index (e.g., stereo is 2, 5.1 channel is 6, etc.) which is used when rendering an ambisonic signal |
| binauralRenderingMode | Indicate a rendering mode which is applied to an ambisonic signal. May indicate a rendering mode in which a head motion is applied after channel rendering or a rendering mode in which channel rendering is performed after applying the head motion |
| eleIdx | Index indicating an order number of an element in audio file/stream (WAV, AAC, Vorbis, etc.) to which an ambisonic signal corresponds |
| isDynmc | Flag indicating whether rotation of an ambisonic signal varies with time |
| Name | Name of an ambisonic signal |
| Lang | Indicating in what language an ambisonic signal was recorded |

A header parameter indicating a channel signal may be referred to as GAO_CHN_HDR. GAO_CHN_HDR may include information indicating information about a speaker layout of a channel signal.

GAO_CHN_HDR may include at least one of pieces of information included in GAO_HOA_HDR. In detail, GAO_CHN_HDR may include at least one of the pieces of information included in the following table.

| Field | Definition |
|---|---|
| layoutIdx | Indicate information about a speaker layout of a channel signal. Follow a CICP index and aligned along each speaker location in the case of indicating an arbitrary layout |

-continued

| Field | Definition |
|---|---|
| eleIdx | Index indicating an order number of an element in audio file/stream (WAV, AAC, Vorbis, etc.) to which a channel signal corresponds |
| isDynmc | Flag indicating whether rotation of a channel signal varies with time |
| Name | Name of a channel signal |
| Lang | Indicating in what language a channel signal was recorded |

A header parameter indicating an channel signal may be referred to as GAO_OBJ_HDR. GAO_OBJ_HDR may include at least one of pieces of information included in GAO_HOA_HDR. In detail, GAO_OBJ_HDR may include at least one of the pieces of information included in the following table.

| Field | Definition |
|---|---|
| eleIdx | Index indicating an order number of an element in audio file/stream (WAV, AAC, Vorbis, etc.) to which an object signal corresponds |
| isDynmc | Flag indicating whether rotation of an object signal varies with time |
| Name | Name of an object signal |
| Lang | Indicating in what language an object signal was recorded |

Embodiments of structures and formats of a metadata parameter will be described with reference to FIG. 8.

Figure 8:
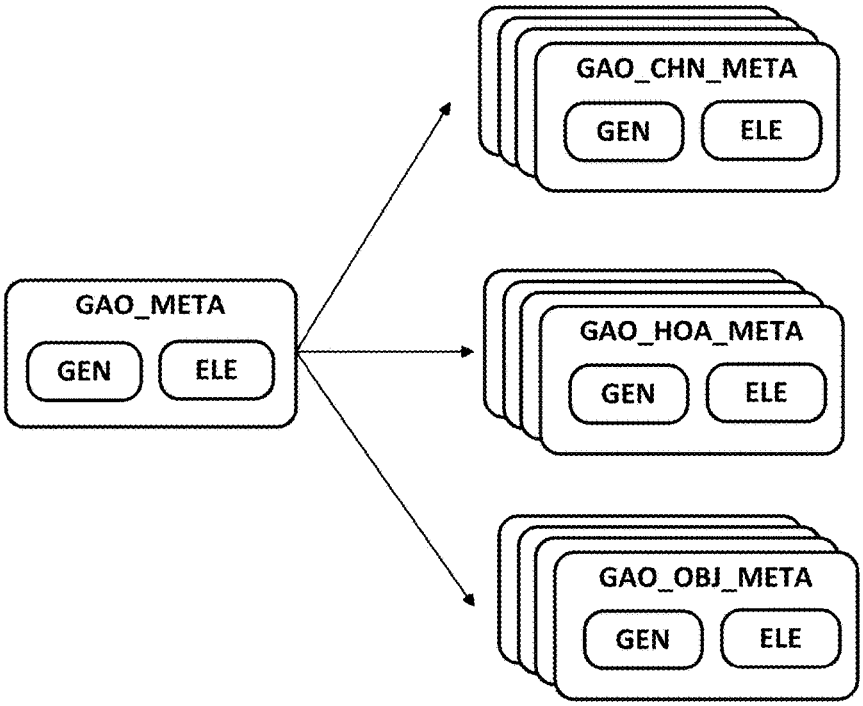
FIG. 8 illustrates a structure of a metadata parameter according to an embodiment of the present disclosure.

FIG. 8 illustrates a structure of a metadata parameter according to an embodiment of the present disclosure.

A metadata parameter may include information for each of types of components included in an audio signal. In detail, the metadata parameter may include information for each of an entire audio signal, an ambisonic signal, an object signal, and a channel signal. Here, the metadata parameter indicating an entire audio signal may be referred to as GAO_META.

When the number of components according to the types of components indicated by GAO_META is at least one, metadata parameters corresponding to respective components may be transferred to the audio signal processing device together with GAO_META. In detail, when the number of components according to the types of components is at least one, GAO_META may include the metadata parameters corresponding to respective components. In detail, when the number of components according to the types of components is at least one, GAO_META may include link information connecting the metadata parameters corresponding to respective components.

A metadata parameter indicating an object signal may be referred to as GAO_META_OBJ. GAO_META_OBJ may include the above-mentioned head tracking application information. Here, the audio signal processing device may obtain, from GAO_META_OBJ, information indicating whether to render the head tracking application information. The audio signal processing device may determine whether to render an object signal by reflecting the head motion of the listener, on the basis of the head tracking application information.

GAO_META_OBJ may include the above-mentioned binaural effect level information. Here, the audio signal processing device may obtain, from GAO_META_OBJ, information indicating the binaural effect level information. Furthermore, the audio signal processing device may determine a binaural rendering application level to be applied to an object signal, on the basis of the binaural effect level information. In detail, the audio signal processing device may determine whether to binaurally render an object signal on the basis of the binaural effect level information.

GAO_META_OBJ may include the above-mentioned sound level information. Here, the audio signal processing device may obtain the sound level information from GAO_META_OBJ. Furthermore, the audio signal processing device may determine whether to perform rendering by reflecting the location of a sound image simulated by an object signal, on the basis of the sound level information. In detail, the audio signal processing device may determine whether to binaurally render an object signal on the basis of the sound level information.

In detail, GAO_META_OBJ may include at least one of the pieces of information shown in the following table.

| Field | Definition |
|---|---|
| o | Matrix which stores metadata for an object signal, and has a dimension of the number of objects (co) × a total frame length (nf) of object signal |
| H | Matrix which stores metadata for an ambisonic signal, and has a dimension of the number of ambisonic signals (ch) × a total frame length (nf) of ambisonic signal |
| C | Matrix which stores metadata for a channel signal, and has a dimension of the number of channel signals (cc) × a total frame length (nf) of channel signal |
| Co | Total number of object signals. Have the same value as NofOBJ of GAO_HDR |
| Ch | Total number of ambisonic signals. Have the same value as NofHOA of GAO_HDR |
| Cc | Total number of channel signals. Have the same value as NofCHN of GAO_HDR |
| Nf | Indicate the total frame number of an audio signal signaled by GAO_META. May be designated as different numbers for each of object signal, ambisonic signal, and channel signal according to specific embodiments. |

| Field | Definition |
|---|---|
| a, e, d | Indicate coordinate values of the location of an object simulated by an object signal. May specifically indicate azimuth, elevation, and distance corresponding to the location of an object. |
| G | Indicate a relative mixing gain value which is applied when an object signal is rendered |
| discardHeadOrientation | Indicate whether to render an object signal without applying a change of a relative position of an object in response to a head motion of a user when rendering the object signal |
| binauralEffectStrengh | Indicate a level of binaural rendering |
| soundLevel | Indicate a sound level of an object signal. When soundLevel is 0, it may be indicated that a corresponding frame is not rendered by reflecting the location of a sound image simulated by an object signal. |

GAO_META_CHN and GAO_META_HOA may include the above-mentioned binaural effect level information. Here, the audio signal processing device may obtain, from GAO_META_CHN or GAO_META_HOA, information indicating the binaural effect level information. Furthermore, the audio signal processing device may determine a binaural rendering application level to be applied to a channel signal, on the basis of the binaural effect level information. In detail, the audio signal processing device may determine whether to binaurally render a channel signal on the basis of the binaural effect level information. Furthermore, the audio signal processing device may determine a binaural rendering application level to be applied to an ambisonic signal, on the basis of the binaural effect level information. In detail, the audio signal processing device may determine whether to binaurally render an ambisonic signal on the basis of the binaural effect level information.

GAO_META_CHN and GAO_META_HOA may include the above-mentioned sound level information. Here, the audio signal processing device may obtain the sound level information from GAO_META_CHN or GAO_META_HOA. Furthermore, the audio signal processing device may determine whether to perform rendering by reflecting the location of a sound image simulated by a channel signal, on the basis of the sound level information. In detail, the audio signal processing device may determine whether to binaurally render a channel signal on the basis of the sound level information. Furthermore, the audio signal processing device may determine whether to perform rendering by reflecting the location of a sound image simulated by an ambisonic signal, on the basis of the sound level information. In detail, the audio signal processing device may determine whether to binaurally render an ambisonic signal on the basis of the sound level information.

GAO_META_CHN and GAO_META_OBJ may include the same type of a parameter. Furthermore, according to an embodiment, GAO_META_CHN and GAO_META_OBJ may include different types of parameters. In detail, GAO_META_CHN and GAO_META_OBJ may include at least one of pieces of information shown in the following table.

| Field | Definition |
|---|---|
| y, p, r | Indicate the degree of rotation of an ambisonic signal/channel signal in a three-dimensional space simulated by each signal. Indicate yaw, pitch, and roll. |
| G | Indicate a relative mixing gain value which is applied when an ambisonic signal/channel signal is rendered |
| discardHeadOrientation | Indicate whether to render an object signal without applying a change of a relative position of an object in response to a head motion of a user when rendering an ambisonic signal/channel signal |
| binauralEffectStrengh | Indicate a level of binaural rendering |
| soundLevel | Indicate a sound level of an ambisonic signal/channel signal. When soundLevel is 0, it may be indicated that a corresponding frame is not rendered by reflecting the location of a sound image simulated by an object signal. |

An audio signal may be transferred in a file form to the audio signal processing device. Furthermore, the audio signal may be transferred to the audio signal processing device through streaming. In addition, the audio signal may be transferred to the audio signal processing device through a broadcast signal. A method of transferring metadata may vary according to a transfer mode of an audio signal. Relevant descriptions will be provided with reference to FIGS. 9 to 12.

Figure 9:
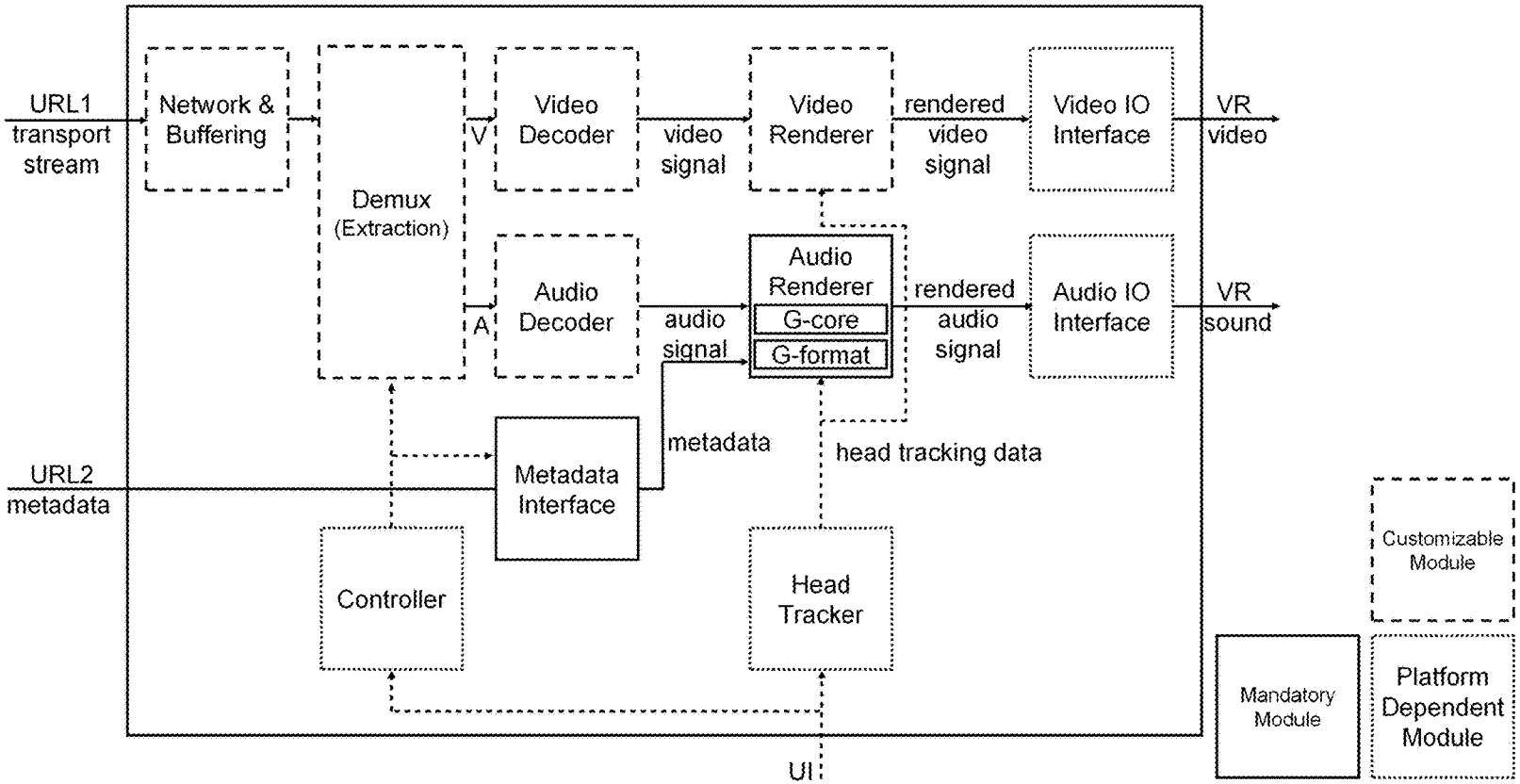
FIG. 9 illustrates an operation in which an audio signal processing device for rendering an audio signal obtains metadata separately from an audio signal according to an embodiment of the present disclosure.

FIG. 9 illustrates an operation in which an audio signal processing device obtains metadata separately from an audio signal according to an embodiment of the present invention.

An audio signal processing device which processes an audio signal to transfer the audio signal may transfer, to an audio signal processing device, metadata separately from an audio bitstream obtained by encoding the audio signal. Therefore, the audio signal processing device which renders an audio signal may obtain the metadata separately from the audio signal. In detail, the audio signal processing device which renders an audio signal may obtain the metadata from a transport file or transport stream different from the audio signal. In a specific embodiment, the audio signal processing device which renders an audio signal may receive the transport stream or the transport file via a first link, and may receive the metadata via a second link. Here, the transport file or the transport stream may include an audio bitstream obtained by encoding an audio signal or may include both the audio bitstream obtained by encoding an audio signal and a video bitstream obtained by encoding a video signal.

FIG. 9 illustrates an image signal processing device including an audio signal processing device according to an embodiment of the present disclosure. The image signal processing device may receive a transport stream including an audio signal and a video signal via a first link URL1. The image signal processing device may receive metadata from a second link URL2. The image signal processing device may extract an audio bitstream A and a video bitstream V by demultiplexing the transport stream. An audio decoder of the audio signal processing device may obtain the audio signal by decoding the audio bitstream A. An audio renderer of the audio signal processing device may receive the audio signal and the metadata. Here, the audio renderer of the audio signal processing device may receive the metadata using a metadata interface. Furthermore, the audio renderer of the audio signal processing device renders the audio signal on the basis of the metadata. This audio renderer may include a module (G-format) for processing metadata and a module (G-core) for processing an audio signal. Furthermore, the audio renderer may render the audio signal on the basis of the head motion of the user of the image signal processing device. The image signal processing device may concurrently output a rendered audio and a rendered video. Furthermore, a video renderer may render a video signal. Here, the video renderer may render the video signal on the basis of the head motion of the user of the image signal processing device. Furthermore, the image signal processing device may receive a user input by using a controller. The controller may control operation of a demultiplexer and the metadata interface. In FIG. 9, solid lines indicate the modules included in the audio signal processing device according to the embodiment of FIG. 9. Furthermore, dotted lines indicate the modules included in the image signal processing device, and these modules may be omitted or replaced.

Figure 10:
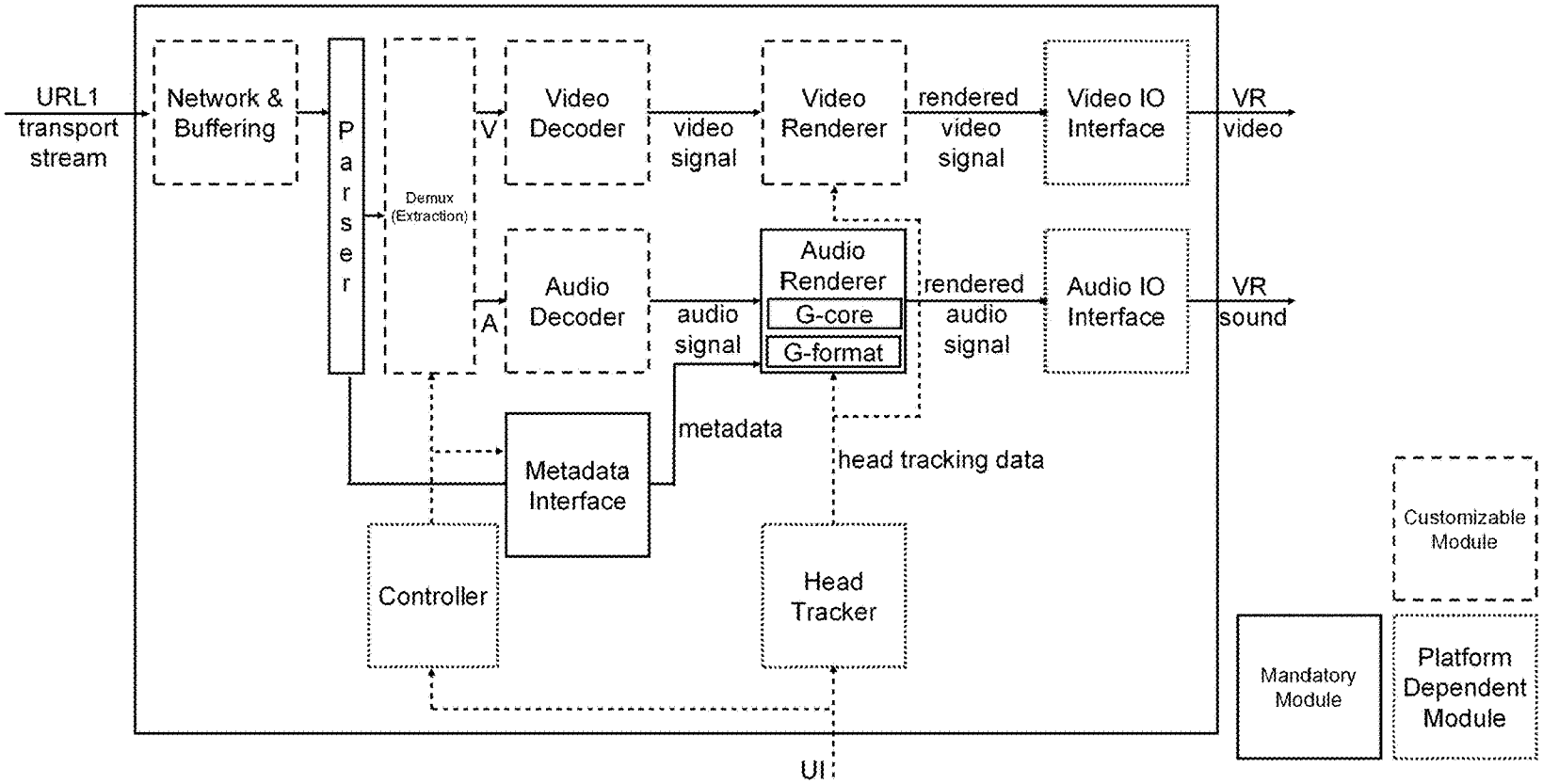
FIG. 10 illustrates an operation in which an audio signal processing device for rendering an audio signal obtains metadata together with an audio signal according to an embodiment of the present disclosure.

FIG. 10 illustrates an operation in which an audio signal processing device for rendering an audio signal obtains metadata together with an audio signal according to an embodiment of the present disclosure.

An audio signal processing device which processes an audio signal to transfer the audio signal may transfer metadata together with an audio bitstream obtained by encoding the audio signal. An audio signal processing device which renders an audio signal may obtain metadata together with the audio signal. In detail, the audio signal processing device which renders the audio signal may obtain the metadata together with the audio signal from the same transport file or transport stream. Here, the transport file or the transport stream may include an audio bitstream obtained by encoding the audio signal and the metadata, or may include all of the audio bitstream obtained by encoding the audio signal, a video bitstream obtained by encoding a video signal, and the metadata. For example, a user data file of the transport file may include metadata. In one embodiment, in the case where the transport file has an MP4 format, UTDA which is a user data field of MP4 may include metadata. In another embodiment, in the case where the transport file has an MP4 format, an individual box or element of MP4 may include metadata.

The embodiment of FIG. 10 illustrates an image signal processing device including an audio signal processing device. The image signal processing device may receive a transport stream including an audio signal, a video signal, and metadata via a first link URL1. The image signal processing device may extract the metadata by parsing the transport stream. Here, the image signal processing device may parse the transport stream using a parser. The image signal processing device may extract an audio signal and a video signal by demultiplexing the transport stream. An audio decoder of the audio signal processing device may decode a demultiplexed audio signal A. An audio renderer of the audio signal processing device may receive the decoded audio signal and metadata. Here, the audio renderer of the audio signal processing device may receive the metadata using a metadata interface. Furthermore, the audio renderer of the audio signal processing device may render the decoded audio signal on the basis of the metadata. Other operations of the audio signal processing device and the image signal processing device may be the same as those of the embodiment described above with reference to FIG. 9.

Figure 11:
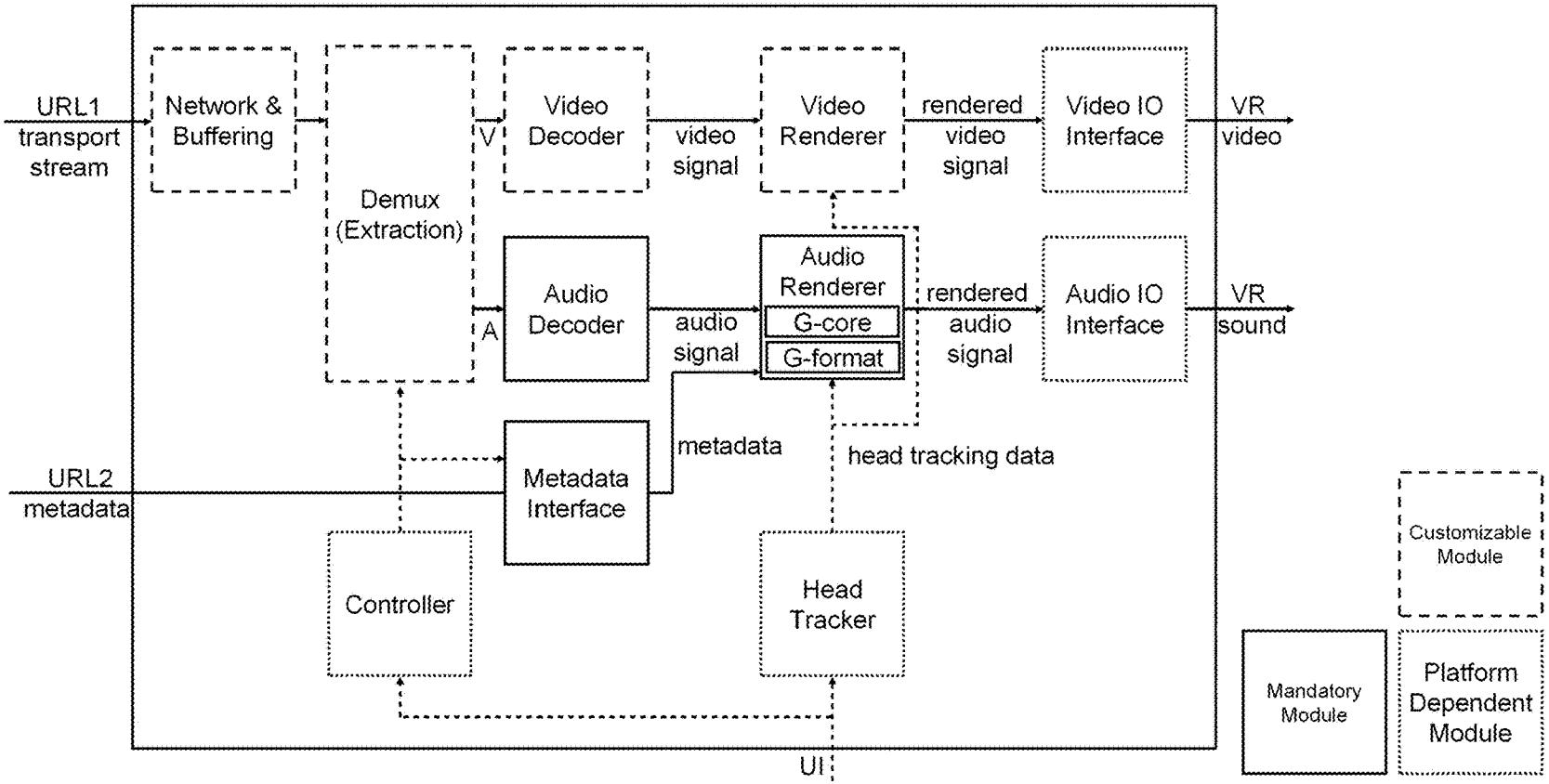
FIG. 11 illustrates an operation in which an audio signal processing device for rendering an audio signal obtains an audio signal together with link information for linking metadata according to an embodiment of the present disclosure.

FIG. 11 illustrates an operation in which an audio signal processing device for rendering an audio signal obtains an audio signal together with link information for linking metadata according to an embodiment of the present disclosure.

An audio signal processing device which processes an audio signal to transfer the audio signal may transmit link information for linking metadata through a transport stream or a transport file. Therefore, the audio signal processing device which renders the audio signal may obtain, from the transport stream or the transport file, the link information for linking the metadata, and may obtain the metadata using the link information. Here, the transport file or the transport stream may include a bitstream obtained by encoding the audio signal or may include both the bitstream obtained by encoding the audio signal and a bitstream obtained by encoding a video signal. For example, a user data field of the transport file may include the link information for linking the metadata. In one embodiment where the transport file has an MP4 format, UTDA which is a user data field of MP4 may include the link information for linking the metadata. In another embodiment, in the case where the transport file has an MP4 format, an individual box or element of MP4 may include the link information for linking the metadata. The audio signal processing device which renders the audio signal may receive the metadata obtained using the link information.

The embodiment of FIG. 11 illustrates an image signal processing device including an audio signal processing device. The image signal processing device may receive the transport stream including the audio signal, the video signal, and the link information for linking the metadata via a first link URL1. The image signal processing device may extract an audio bitstream A, a video bitstream V, and the link information for linking the metadata by demultiplexing the transport stream. An audio decoder of the audio signal processing device may obtain an audio signal by decoding the audio bitstream A. The audio renderer of the audio signal processing device may receive the metadata from a second link URL2 indicated by the link information, using a metadata interface. The audio renderer of the audio signal processing device may receive the audio signal and the metadata. Furthermore, the audio renderer of the audio signal processing device may render the audio signal on the basis of the metadata. Other operations of the audio signal processing device and the image signal processing device may be the same as those of the embodiment described above with reference to FIG. 9.

Figure 12:
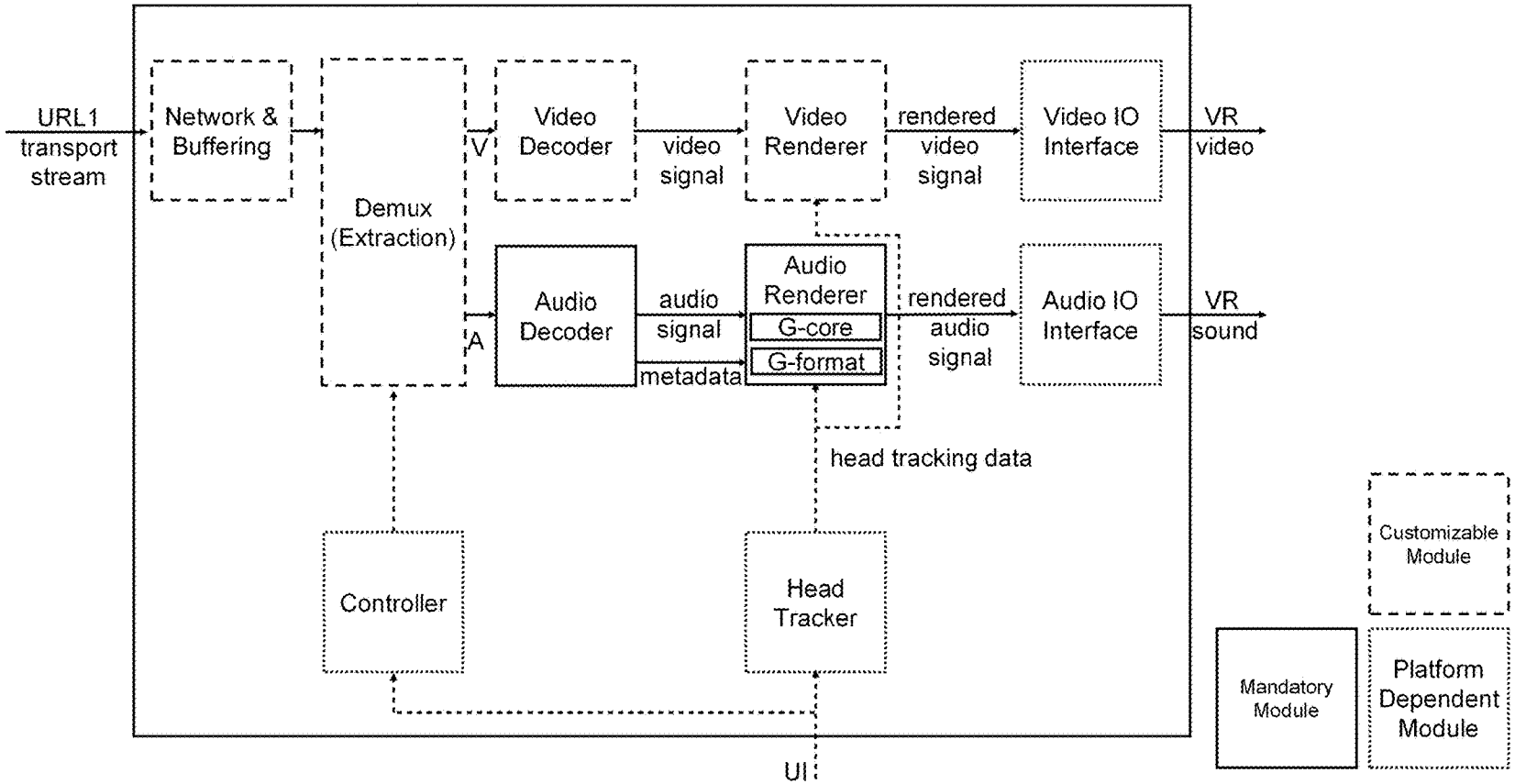
FIGS. 12 and 13 illustrate an operation in which an audio signal processing device for rendering an audio signal obtains metadata on the basis of an audio bitstream according to an embodiment of the present disclosure.
Figure 13:
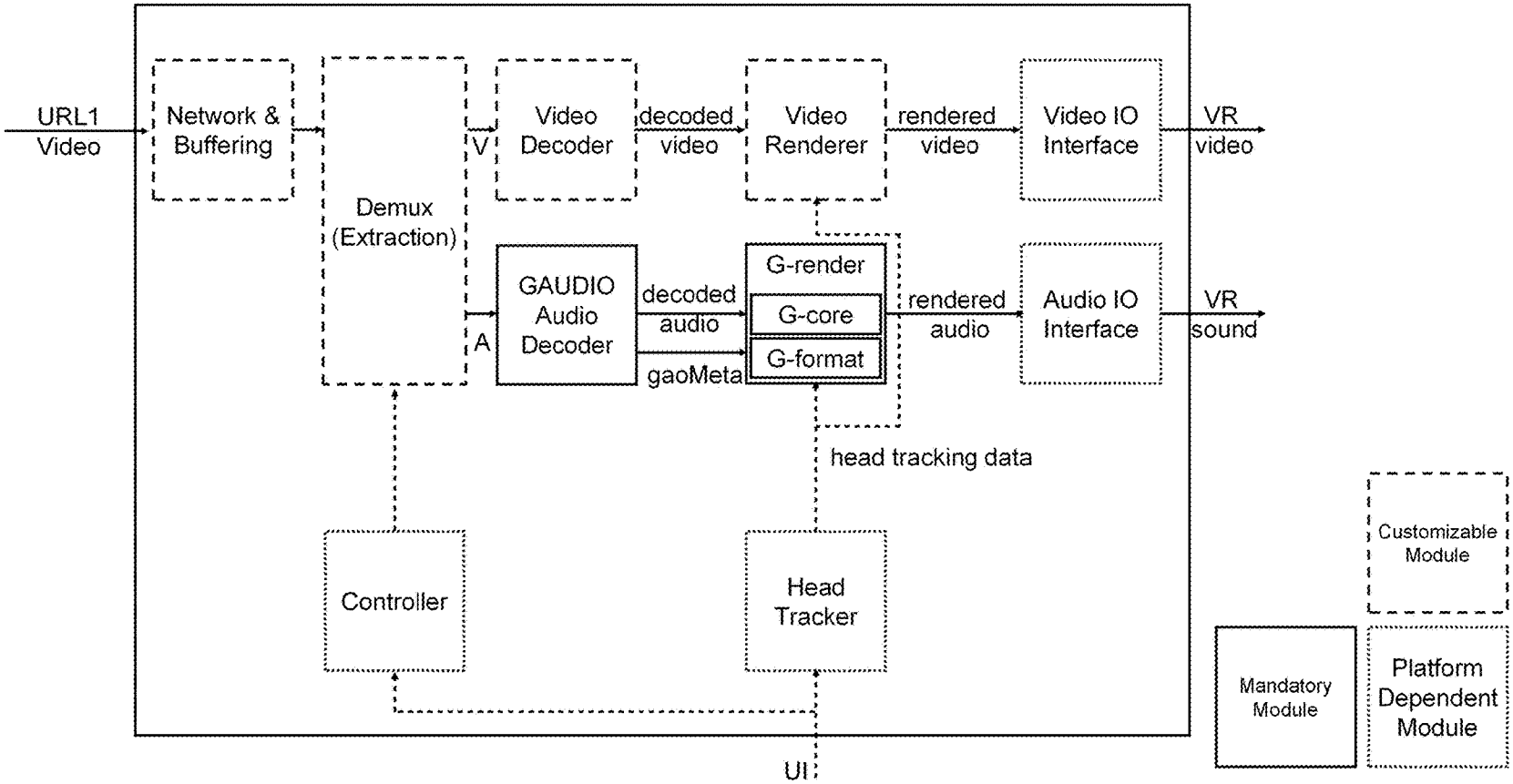

FIGS. 12 and 13 illustrate an operation in which an audio signal processing device for rendering an audio signal obtains metadata on the basis of an audio bitstream according to an embodiment of the present disclosure.

An audio signal processing device which processes an audio signal to transfer the audio signal may insert metadata into an audio bitstream. Therefore, the audio signal processing device which renders the audio signal may obtain the metadata from the audio bitstream. In one embodiment, a user data file of the audio bitstream may include the metadata. Accordingly, the audio signal processing device which renders the audio signal may include a parser for parsing the metadata from the audio bitstream. In another embodiment, a decoder of the audio signal processing device may obtain the metadata from the bitstream.

In the embodiment of FIG. 12, the parser of the audio signal processing device may obtain the metadata from the audio bitstream. An audio renderer of the audio signal processing device may receive the metadata from the parser. In the embodiment of FIG. 13, an audio decoder of the audio signal processing device may obtain the metadata from the audio bitstream. An audio renderer of the audio signal processing device may receive the metadata from the audio decoder of the audio signal processing device. In the embodiments of the FIGS. 12 and 13, other operations of the audio signal processing device and the image signal processing device may be the same as those of the embodiment described above with reference to FIG. 9.

In the case where the audio signal processing device receives an audio signal through streaming, the audio signal processing device may receive the audio signal in a middle of the streamlining. Therefore, pieces of information required for rendering the audio signal may be transmitted periodically. Relevant descriptions will be described with reference to FIGS. 14 to 16B.

Figure 14:
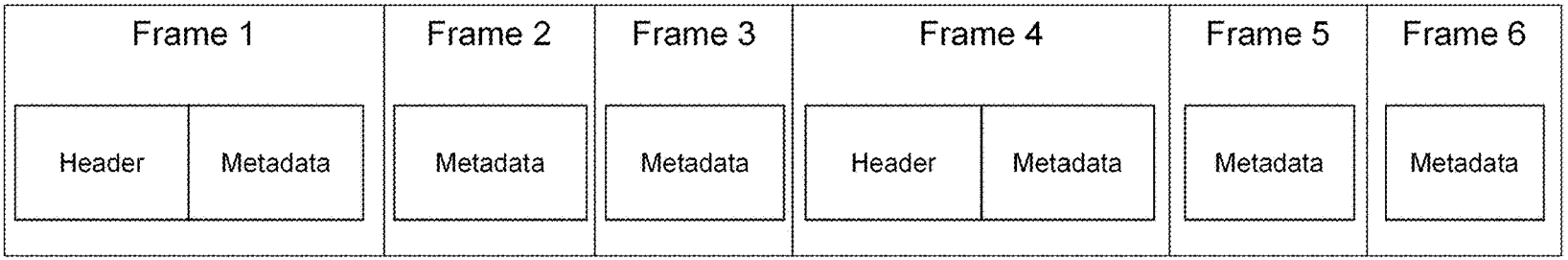
FIG. 14 illustrates a method in which an audio signal processing device for rendering an audio signal according to an embodiment of the present disclosure obtains metadata when receiving an audio signal through transport streaming.

FIG. 14 illustrates a method in which an audio signal processing device obtains metadata when receiving an audio signal through transport streaming according to an embodiment of the present disclosure.

An audio signal processing device which processes an audio signal to transfer the audio signal may periodically insert metadata into a multimedia stream. Here, the audio signal processing device which processes the audio signal to transfer the audio signal may insert the metadata into the multimedia stream on a frame-by-frame basis. In an embodiment, the audio signal processing device which processes the audio signal to transfer the audio signal may periodically insert the above-mentioned header parameter and metadata parameter into the multimedia stream. Here, the audio signal processing device which processes an audio signal to transfer the audio signal may insert the header parameter into the multimedia stream at an interval of period which may be longer than an interval of period at which the metadata parameter is inserted into the multimedia stream. In detail, in the case where the length of the metadata parameter included in a frame is smaller than the length of the metadata parameter included in another frame, the audio signal processing device which processes an audio signal to transfer the audio signal may insert the header parameter into the frame.

Therefore, the audio signal processing device which renders the audio signal may periodically obtain the metadata from the multimedia stream. In detail, the audio signal processing device which renders an audio signal may obtain the metadata from the multimedia stream on a frame-by-frame basis. In the case where the audio signal processing device which renders an audio signal obtains the metadata on a frame-by-frame basis, the audio signal processing device which renders an audio signal may not need to re-pack the audio signal and the metadata in order to synchronize the audio signal with the metadata. Furthermore, the audio signal processing device which renders the audio signal may efficiently manage the metadata and the audio signal. Exemplary syntaxes of the metadata will be described with reference to FIGS. 15A to 16B.

FIGS. 15A to 16B illustrate a syntax of an AAC file according to an embodiment of the present disclosure. In detail, FIG. 15A illustrates a syntax in which the audio signal processing device determines an ID of an element included in the AAC file according to an embodiment of the present disclosure. FIGS. 15B and 15C illustrate a data stream element parsing operation syntax of the audio signal processing device according to an embodiment of the present disclosure.

As described above, the multimedia stream may include metadata on a frame-by-frame basis. In detail, in the case where an AAC file is transmitted through streaming, the syntaxes as illustrated in FIGS. 15 and 16 may be provided. The audio signal processing device may determine whether the ID of an element included in the AAC file indicates a data stream element ID_DSE. In the case where the ID of an element included in the AAC file indicates the data stream element ID_DSE, the audio signal processing device may perform a data stream element parsing operation GaoReadDSE.

FIG. 16A illustrates a syntax of the above-mentioned header parameter. FIG. 16B illustrates a syntax of the above-mentioned metadata parameter. The audio signal processing device parses the header parameter GaoReadDSEHDR and parses the metadata parameter GaoReadDSEMeta.

The number of channels that may be decoded/rendered by a legacy audio signal processing device which does not support the embodiments of the present disclosure may be smaller than the number of channels that may be decoded/rendered by the audio signal processing device according to an embodiment of the present disclosure. Furthermore, a legacy audio file format may only include an audio signal with a smaller number of channels than the number of channels that may be decoded/rendered by the audio signal processing device. Therefore, it may be difficult to transmit, through the legacy audio file format, an audio signal for the audio signal processing device according to an embodiment of the present disclosure. Furthermore, usage of a new file format may cause an issue of compatibility with the legacy audio signal processing device. A method for processing an audio signal using the legacy audio file format will be described with reference to FIGS. 17A to 17B.

FIGS. 17A to 17D illustrates a method for processing an audio signal using an audio file format that supports a smaller number of channels than a total number of channels included in the audio signal according to an embodiment of the present disclosure.

In the case where an audio file includes a plurality of pieces of content, the audio file may include a plurality of tracks. For example, a single audio file may include a plurality of tracks in which the same movie dialogue is recorded in different languages. In another example, an audio file may include a plurality of tracks including different pieces of music. The audio signal processing device which processes the audio signal to transfer the audio signal may encode, into an audio file, an audio signal having a larger number of channels than the number of channels supported by the audio file by using audio file tracks.

In detail, the audio signal processing device which processes an audio signal to transfer the audio signal, may distributively insert a plurality of audio signal components of the audio signal into a plurality of tracks included in an audio file. Here, the plurality of audio signal components may be at least one of an object signal, a channel signal, or an ambisonic signal. Furthermore, each track of the audio file may only support a smaller number of channels than a total number of channels of the plurality of signal components. The number of channels of signal components included in each track of the audio file may be smaller than the number of channels supported by each track of the audio file. When an audio signal includes a first signal component and a second signal component, the audio signal processing device which processes the audio signal to transfer the audio signal may insert, into a first track of the audio file, the first signal component that supports the number of channels supported by the audio file and may insert the second signal component into a second track of the audio file. As described above, the first track may be a pre-designated track. Furthermore, the first signal component may be an audio signal component that may be rendered without metadata for expressing the location of a sound image simulated by an audio signal. For example, the first signal component may be an audio signal component that may be rendered without metadata for binaural rendering. Furthermore, the audio signal processing device which processes an audio signal to transfer the audio signal may insert signal components other than the first signal components according to a pre-designated track order. In another specific embodiment, the audio signal processing device which processes an audio signal to transfer the audio signal may insert metadata into the first track. Here, the metadata may indicate a track including the signal components other than the first signal component. Furthermore, the metadata may be used to render an audio signal. In detail, examples of the metadata are described above with reference to FIGS. 3A to 8.

The audio signal processing device which renders an audio signal may simultaneously render the audio signal components included in the plurality of tracks included in the audio file. Here, the plurality of audio signal components may be at least one of an object signal, a channel signal, or an ambisonic signal. As described above, each track of the audio file may support a smaller number of channels than a total number of channels of the plurality of audio signal components. In detail, the audio signal processing device which renders the audio signal may concurrently render a first audio signal component included in a first track and a second audio signal component included in a second track of the audio file. In an exemplary embodiment, as described above, the first track may be a track of a pre-designated location among a plurality of tracks. For example, the first track may be a first track among the plurality of tracks of the audio file. Here, the audio signal processing device which renders an audio signal may check whether the plurality of tracks of the audio file include audio signal components, by using a pre-designated track order. In another embodiment, the audio signal processing device which renders the audio signal may obtain metadata from the first track, and may obtain audio signal components on the basis of the obtained metadata. In detail, the audio signal processing device which renders an audio signal may determine a track including the audio signal components on the basis of the obtained metadata. Furthermore, the audio signal processing device which renders an audio signal may obtain metadata from the first track, and may render audio signal components on the basis of the metadata. In detail, examples of the metadata are described above with reference to FIGS. 3A to 8.

Furthermore, the audio signal processing device which renders an audio signal may select a plurality of tracks included in an audio file according to a capability of the audio signal processing device, and may render the selected tracks. In detail, the audio signal processing device which renders the audio signal may select the plurality of tracks according to features of audio components included in each of the plurality of tracks and the capability of the audio signal processing device. In the above-mentioned embodiment, the audio signal processing device which renders the audio signal may select the first audio signal component and the second audio signal component according to the capability of the audio signal processing device.

In the embodiment of FIGS. 17A to 17D, the audio signal processing device which processes an audio signal to transfer the audio signal may encode an FOA signal and metadata into a single track as illustrated in FIG. 17A. In the embodiment of FIGS. 17A to 17B, the audio signal processing device which renders an audio signal may generate an AAC file included in an MP4 file of FIG. 17B. For example, the audio signal processing device which processes the audio signal to transfer the audio signal inserts a first ambisonic signal FOA and the metadata into a first track TRK0 of the AAC file. The audio signal processing device which processes an audio signal to transfer the audio signal inserts a first object signal OBJ0 and a second object signal OBJ1 into a second track TRK1 of the AAC file. Furthermore, the audio signal processing device which processes an audio signal to transfer the audio signal inserts a third object signal OBJ2 and a fourth object signal OBJ3 into a third track TRK2 of the AAC file. Furthermore, the audio signal processing device which processes an audio signal to transfer the audio signal inserts a fifth object signal OBJ4 and a sixth object signal OBJ5 into a fourth track TRK3 of the AAC file. Furthermore, the audio signal processing device which processes an audio signal to transfer the audio signal inserts a seventh object signal OBJ6 and an eighth object signal OBJ7 into a fifth track TRK4 of the AAC file. Furthermore, the audio signal processing device which processes an audio signal to transfer the audio signal inserts a second ambisonic signal FOA1 into a sixth track TRK5 of the AAC file. Here, the second ambisonic signal FOA1 may be a primary ambisonic signal including four channels. Furthermore, the audio signal processing device which processes an audio signal to transfer the audio signal inserts a third ambisonic signal HOA2 into a seventh track TRK6 of the AAC file. The third ambisonic signal HOA2 includes five channels, and the second ambisonic signal HOA1 and the third ambisonic signal HOA2 constitute a secondary ambisonic signal. Furthermore, the audio signal processing device which processes an audio signal to transfer the audio signal inserts a fourth ambisonic signal HOA3 into an eighth track TRK7 of the AAC file. The fourth ambisonic signal HOA3 includes seven channels, and the second ambisonic signal HOA1, the third ambisonic signal HOA2, and the fourth ambisonic signal HOA3 constitute a tertiary ambisonic signal.

In the embodiment of FIG. 17C, a decoder of the audio signal processing device which renders an audio signal decodes audio signals included in the tracks of the AAC file. Here, the decoder of the audio signal processing device which renders an audio signal may not decode the metadata Meta included in the first track TRK0. As described above, the audio signal processing device which renders an audio signal may determine tracks of the AAC file which include audio signal components on the basis of the metadata Meta to decode audio signals included in the tracks of the AAC file. In the embodiment of FIG. 17D, a renderer of the audio signal processing device which renders an audio signal may render audio signal components OBJ/HOA/CHN Audio included in the tracks of the AAC file on the basis of metadata OBJ/HOA/CHN Metadata. In particular, the audio signal processing device which renders an audio signal may selectively render a plurality of tracks according to the capability of the audio signal processing device. For example, the audio signal processing device capable of rendering a signal including four channels may render the second ambisonic signal FOA1. Here, the audio signal processing device capable of rendering a signal including nine channels may simultaneously render the second ambisonic signal FOA1 and the third ambisonic signal HOA2. Furthermore, the audio signal processing device capable of rendering a signal including 16 channels may simultaneously render the second ambisonic signal FOA1, the third ambisonic signal HOA2, and the fourth ambisonic signal HOA3.

Through these embodiments, the audio signal processing device which renders an audio signal may render the audio signal including a larger number of channels than the number of channels supported by an individual track of an audio file format. Furthermore, compatibility between audio signal processing devices which support decoding/rendering of different numbers of channels may be secured.

Figure 18:
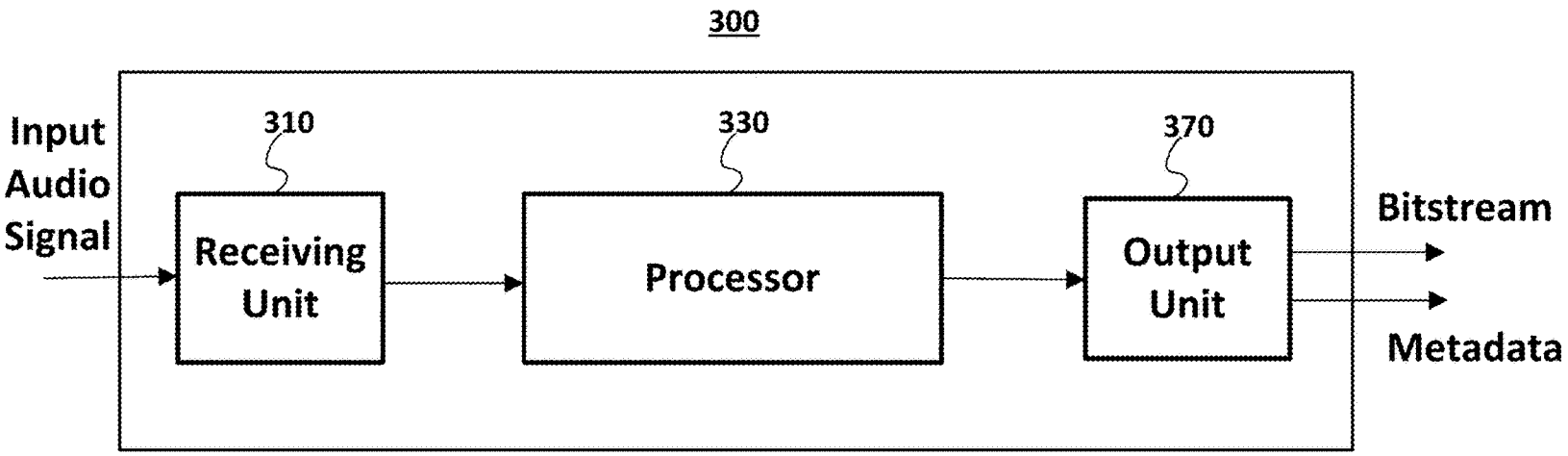
FIG. 18 is a block diagram illustrating an audio signal processing device which processes an audio signal to transfer the audio signal according to an embodiment of the present disclosure.

FIG. 18 is a block diagram illustrating an audio signal processing device which processes an audio signal to transfer the audio signal according to an embodiment of the present disclosure.

According to an embodiment of the present disclosure, an audio signal processing device 300 for processing an audio signal to transfer the audio signal may include a receiving unit 310, a processor 330, and an output unit 370.

The receiving unit 10 may receive an input audio signal. Here, the audio signal may be a signal obtained by converting a sound collected by a sound collecting device. The sound collecting device may be a microphone. Furthermore, the sound collecting device may be a microphone array including a plurality of microphones.

The processor 30 may encode the input audio signal received by the receiving unit 310 to generate a bitstream, and generates metadata for the audio signal. In an embodiment, the processor 330 may include a format converter and a metadata generator. The format converter may convert a format of the input audio signal into another format. For instance, the format converter may convert an object signal into an ambisonic signal. Here, the ambisonic signal may be a signal recorded through a microphone array. In another example, the ambisonic signal may be a signal obtained by converting a signal recorded through a microphone array into a coefficient for a base of spherical harmonics. Furthermore, the format converter may convert the ambisonic signal into the object signal. In detail, the format converter may change an order of the ambisonic signal. For example, the format converter may convert a higher order ambisonics (HoA) signal into a first order ambisonics (FoA) signal. Furthermore, the format converter may obtain location information related to the input audio signal, and may convert the format of the input audio signal on the basis of the obtained location information. Here, the location information may be information about a microphone array which has collected a sound corresponding to an audio signal. In detail, the information about the microphone array may include at least one of arrangement information, number information, location information, frequency characteristic information, or beam pattern information of microphones constituting the microphone array. Furthermore, the location information related to the input audio signal may include information indicating the location of a sound source.

The metadata generator may generate metadata corresponding to the input audio signal. In detail, the metadata generator may generate the metadata which is used to render the input audio signal. Here, the metadata may be the metadata of the embodiments described above with reference to FIGS. 3A to 17D. Furthermore, the metadata may be transferred to the audio signal processing device according to the embodiments described above with reference to FIGS. 9 to 17D.

Furthermore, the processor 330 may distributively insert a plurality of audio signal components of an audio signal into a plurality of tracks included in an audio file format. Here, the plurality of audio signal components may be at least one of an object signal, a channel signal, or an ambisonic signal. In detail, the processor 330 may operate in the same manner as described above with reference to FIGS. 17A to 17D.

The output unit 370 may output the bitstream and the metadata.

Figure 19:
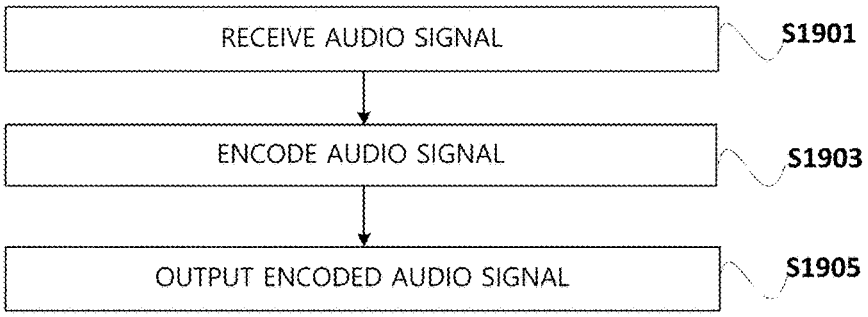
FIG. 19 is a flowchart illustrating a method for operating an audio signal processing device which processes an audio signal to transfer the audio signal according to an embodiment of the present disclosure.

FIG. 19 is a flowchart illustrating a method for operating an audio signal processing device to transfer an audio signal according to an embodiment of the present disclosure.

The audio signal processing device which processes an audio signal to transfer the audio signal may receive an audio signal (S1901).

The audio signal processing device may encode the received audio signal (S1903). In detail, the audio signal processing device may generate metadata for the audio signal. The metadata may be used to render the audio signal. Here, the rendering may be binaural rendering. In detail, the audio signal processing device may generate the metadata for the audio signal which includes information for reflecting the location of a sound image simulated by an audio signal. The audio signal processing device may insert, into the metadata, a sound level corresponding to a time interval indicated by the metadata. Here, the sound level may be used to determine whether to render the audio signal by reflecting the location of a sound image simulated by the audio signal.

In an exemplary embodiment, the audio signal processing device may insert, into metadata, binaural effect level information indicating a level of binaural rendering which is applied to an audio signal. Here, the binaural effect level information may be used to change a relative magnitude of an HRTF or a BRIR. Furthermore, the binaural effect level information may indicate the level of binaural rendering for each audio signal component of the audio signal. Furthermore, the binaural effect level information may also indicate the level of binaural rendering on a frame-by-frame basis.

The audio signal processing device may insert, into the metadata, motion application information indicating whether to render an audio signal by reflecting the motion of the listener. Here, the motion of the listener may include the head motion of the listener.

The audio signal processing device may insert, into the metadata, personalization parameter application information indicating whether to allow application of a personalization parameter which may be set according to the listener. Here, the personalization parameter application information may indicate non-permission of application of the personalization parameter. A specific format of the metadata may be the same as described above with reference to FIGS. 3A to 16B.

The audio signal processing device may generate an audio file which includes, in a plurality of tracks, a plurality of audio signal components of the received audio signal. In detail, the audio signal processing device may generate an audio file which includes a first audio signal component of the audio signal in a first track and includes a second audio signal component of the audio signal in a second track. Here, the number of audio signal channels supported by each of the first track and the second track may be smaller than a total number of channels of the audio signal. Furthermore, the first track may be a track located in a pre-designated location among the plurality of tracks of the audio file. In detail, the first track may be a first track among the plurality of tracks. Furthermore, an audio signal encoding device may insert metadata into the first track. Here, the metadata may indicate which track among the plurality of tracks of the audio file includes the audio signal components of the audio signal. In another embodiment, the audio signal processing device may insert, into the plurality of tracks, the plurality of audio signal components of the audio signal in a designated order. In detail, the audio signal processing device which processes the audio signal to transfer the audio signal may operate in the same manner as described above with reference to FIGS. 17A and 18.

The audio signal processing device outputs the encoded audio signal (S1905). Furthermore, the audio signal processing device may output generated metadata. Furthermore, the audio signal processing device may output a generated audio file.

Figure 20:
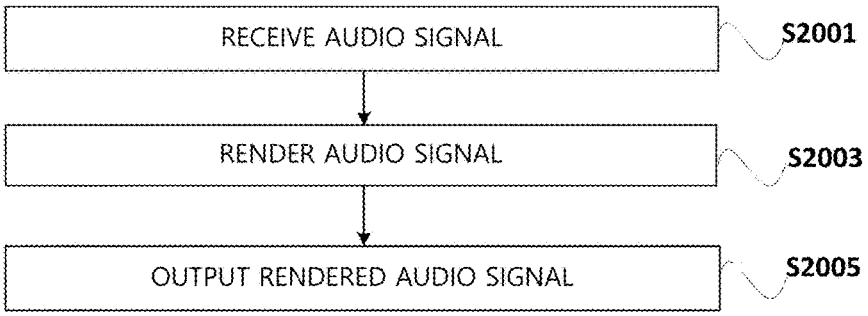
FIG. 20 is a flowchart illustrating a method for operating an audio signal processing device for rendering an audio signal according to an embodiment of the present disclosure.

FIG. 20 is a flowchart illustrating a method for operating an audio signal processing device for rendering an audio signal according to an embodiment of the present invention.

The audio signal processing device which renders an audio signal receives an audio signal (S2001). For example, the audio signal processing device may receive an audio file including the audio signal.

The audio signal processing device may render the received audio signal (S2003). The audio signal processing device may binaurally render the received audio signal. Furthermore, the audio signal processing device may render the audio signal by reflecting the location of a sound image simulated by the audio signal on the basis of metadata for the received audio signal. In detail, the audio signal processing device may determine whether to render the audio signal by reflecting the location of a sound image simulated by the audio signal. Here, the audio signal processing device may render the audio signal according to a result of the determination.

In an embodiment, the metadata may include sound level information indicating a sound level corresponding to a time interval indicated by the metadata. The audio signal processing device may determine whether to render an audio signal by reflecting the location of a sound image simulated by the audio signal, on the basis of the sound level information. For example, the audio signal processing device may compare the sound level of the audio signal corresponding to a first time interval with the sound level of the audio signal corresponding to a second time interval. Here, the audio signal processing device may determine, on the basis of a result of the comparison, whether to render the audio signal corresponding to the second time interval by reflecting the location of the sound image simulated by the audio signal corresponding to the second time interval. Here, the first time interval may be prior to the second time interval. Furthermore, the first time interval and the second time interval may be consecutive time intervals. In another embodiment, the audio signal processing device may determine whether to render the audio signal by reflecting the location of the sound image simulated by the audio signal, on the basis of whether a sound level indicated by the sound level information is smaller than a predetermined value. In detail, the audio signal processing device may render the audio signal without reflecting the location of the sound image simulated by the audio signal when the sound level information indicates muteness.

Furthermore, the metadata may include binaural effect level information indicating the level of application of binaural rendering. Here, the audio signal processing device may determine the binaural rendering application level for the audio signal on the basis of the binaural effect level information. Furthermore, the audio signal processing device may binaurally render the audio signal using the determined binaural rendering application level. In detail, the audio signal processing device may change a relative magnitude of an HRFT or a BRIR for binaural rendering according to the determined binaural rendering application level. The binaural effect level information may indicate the level of binaural rendering for each component of the audio signal. Furthermore, the binaural effect level information may indicate the level of binaural rendering on a frame-by-frame basis.

Furthermore, in the above-mentioned embodiments, the audio signal processing device may render an audio signal by applying a fade-in/fade-out effect according to whether determination on whether to perform rendering by applying the location of a sound image simulated by the audio signal is changed.

Furthermore, the metadata may include motion application information indicating whether to render an audio signal by reflecting the motion of the listener. Here, the audio signal processing device may determine whether to render an audio signal by reflecting the motion of the listener, on the basis of the motion application information. In detail, the audio signal processing device may render an audio signal without reflecting the motion of the listener according to the motion application information. Here, the motion of the listener may include the head motion of the listener.

Furthermore, the metadata may include personalization parameter application information indicating whether to allow application of a personalization parameter which may be set according to the listener. Here, the audio signal processing device may render an audio signal on the basis of the personalization parameter application information. In detail, the audio signal processing device may render an audio signal without applying the personalization parameter according to the personalization parameter application information. Examples of format of the metadata are described above with reference to FIGS. 3A to 16B. Furthermore, the metadata may be transferred in the same manner as described above with reference to FIGS. 9 to 14.

The audio signal processing device may simultaneously render a plurality of audio signal components included in each of a plurality of tracks of an audio file including an audio signal. The audio signal processing device may simultaneously render a first audio signal component included in a first track of the audio file including the audio signal and a second audio signal component included in a second track of the audio file including the audio signal. Here, the number of audio signal channels supported by each of the first track and the second track may be smaller than a total number of channels of the audio signal. The first track may be a track included in a pre-designated location among the plurality of tracks of the audio file. Furthermore, the first track may include metadata. Here, the audio signal processing device may determine tracks of the audio file which include audio signal components, on the basis of the metadata. Furthermore, the audio signal processing device may render the first audio signal component and the second audio signal component on the basis of the metadata. In detail, the audio signal processing device may binaurally render the first audio signal component and the second audio signal component on the basis of the metadata. Furthermore, the audio signal processing device may confirm whether the plurality of tracks of the audio file include the audio signal components of the audio signal, in a pre-designated track order.

The audio signal processing device outputs the rendered audio signal (S2005). As described above, the audio signal processing device may output the rendered audio signal through at least two loud speakers. In another embodiment, the audio signal processing device may output the rendered audio signal through a 2-channel stereo headphone.

Although the present invention has been described using the specific embodiments, those skilled in the art could make changes and modifications without departing from the spirit and the scope of the present invention. That is, although the embodiments for processing multi-audio signals have been described, the present invention can be equally applied and extended to various multimedia signals including not only audio signals but also video signals. Therefore, any derivatives that could be easily inferred by those skilled in the art from the detailed description and the embodiments of the present invention should be construed as falling within the scope of right of the present invention.

The invention claimed is:

1. An audio signal processing device for rendering an audio signal, comprising:

a receiving unit configured to receive the audio signal;

a processor configured to determine whether to apply, according to metadata for the audio signal, a location of a sound image simulated by the audio signal to a binaural rendering of the audio signal, and binaurally render the audio signal according to a result of the determination; and an output unit configured to output the binaurally rendered audio signal.

2. The audio signal processing device of claim 1, wherein the metadata includes sound level information indicating a sound level corresponding to a time interval indicated by the metadata, wherein the processor determines whether to apply, according to the sound level information, the location of the sound image simulated by the audio signal to the binaural rendering of the audio signal, on the basis of the sound level information.

3. The audio signal processing device of claim 2, wherein the processor compares a sound level of the audio signal corresponding to a first time interval with a sound level of the audio signal corresponding to a second time interval to determine whether to apply a location of a sound image simulated by the audio signal corresponding to the second time interval to a binaural rendering of the audio signal corresponding to the second time interval, wherein the first time interval is prior to the second time interval.

4. The audio signal processing device of claim 2, wherein the processor determines whether to apply the location of the sound image simulated by the audio signal to the binaural rendering of the audio signal, on the basis of whether a sound level indicated by the sound level information is smaller than a pre-designated value.

5. The audio signal processing device of claim 1, wherein the metadata includes binaural effect level information indicating a level of application of binaural rendering, wherein the processor determines the binaural rendering application level for the audio signal on the basis of the binaural effect level information, and binaurally render the audio signal with the determined binaural rendering application level.

6. The audio signal processing device of claim 5, wherein the processor changes a level of application of a head related transfer function (HRFT) or a binaural rendering impulse response (BRIR) for binaural rendering according to the determined binaural rendering application level.

7. The audio signal processing device of claim 5, wherein the binaural effect level information indicates the level of binaural rendering for each component of the audio signal.

8. The audio signal processing device of claim 5, wherein the binaural effect level information indicates the level of binaural rendering on a frame-by-frame basis.

9. The audio signal processing device of claim 1, wherein the metadata includes motion application information indicating whether to apply a motion of a listener to the binaural rendering of the audio signal, wherein the processor determines whether to apply the motion of the listener to rendering of the audio signal, on the basis of the motion application information.

10. The audio signal processing device of claim 1, wherein the processor binaurally renders the audio signal by applying a fade-in/fade-out effect according to whether determination on whether to perform rendering by applying the location of the sound image simulated by the audio signal is changed.

11. The audio signal processing device of claim 1, wherein the metadata includes personalization parameter application information indicating whether to allow application of a personalization parameter which is capable of being set according to the listener, wherein the processor binaurally renders the audio signal without applying the personalization parameter according to the personalization parameter application information.

12. An audio signal processing device for processing an audio signal to transfer the audio signal, comprising:

a receiving unit configured to receive the audio signal;

a processor configured to generate metadata for the audio signal, the metadata including information for determining whether to apply a location of a sound image simulated by the audio signal to a binaural rendering of the audio signal; and an output unit configured to output the metadata.

13. The audio signal processing device of claim 12, wherein the processor inserts, into the metadata, a sound level corresponding to a time interval indicated by the metadata, wherein the sound level is used to determine whether to apply the location of the sound image simulated by the audio signal to the binaural rendering of the audio signal.

14. The audio signal processing device of claim 12, wherein the processor inserts, into the metadata, binaural effect level information indicating a level of binaural rendering which is applied to the audio signal.

15. The audio signal processing device of claim 14, wherein the binaural effect level information is used to change a level of application of a head related transfer function (HRFT) or a binaural rendering impulse response (BRIR) for the binaural rendering.

16. The audio signal processing device of claim 14, wherein the binaural effect level information indicates the level of binaural rendering for each audio signal component of the audio signal.

17. The audio signal processing device of claim 14, the binaural effect level information indicates the level of application of binaural rendering on a frame-by-frame basis.

18. The audio signal processing device of claim 12, wherein the processor inserts, into the metadata, the motion application information indicating whether to apply a motion of a listener to rendering of the audio signal.

19. The audio signal processing device of claim 18, wherein the motion of the listener includes a head motion of the listener.

20. A method for operating an audio signal processing device, comprising:

receiving an audio signal;

determining whether to apply, according to metadata for the audio signal, a location of a sound image simulated by the audio signal to binaural rendering of the audio signal;

binaurally rendering the audio signal according to a result of the determination; and outputting the rendered audio signal.

* * * * *